US009595220B2

(12) United States Patent
Jang

(10) Patent No.: US 9,595,220 B2
(45) Date of Patent: Mar. 14, 2017

(54) ORGANIC LIGHT-EMITTING DIODE DISPLAY AND METHOD OF DRIVING THE SAME

(71) Applicant: Samsung Display Co., Ltd., Yongin, Gyeonggi-Do (KR)

(72) Inventor: Hwan-Soo Jang, Cheonan-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 78 days.

(21) Appl. No.: 14/561,051

(22) Filed: Dec. 4, 2014

(65) Prior Publication Data

US 2015/0294616 A1 Oct. 15, 2015

(30) Foreign Application Priority Data

Apr. 10, 2014 (KR) ..... 10-2014-0042954

(51) Int. Cl.
*G09G 3/3208* (2016.01)
*G09G 3/32* (2016.01)

(52) U.S. Cl.
CPC ..... *G09G 3/3208* (2013.01); *G09G 3/3283* (2013.01); *G09G 2300/043* (2013.01); *G09G 2300/0452* (2013.01); *G09G 2310/0278* (2013.01); *G09G 2310/08* (2013.01); *G09G 2320/0233* (2013.01); *G09G 2320/0242* (2013.01)

(58) Field of Classification Search
CPC .. G09G 3/3208; G09G 3/3283; G09G 3/3275; G09G 3/3216
USPC ..... 345/691
See application file for complete search history.

(56) References Cited

U.S. PATENT DOCUMENTS

2006/0202928 A1 9/2006 Edwards
2010/0295760 A1* 11/2010 Somerville ..... G09G 3/3216 345/82
2010/0295861 A1* 11/2010 Somerville ..... G09G 3/3216 345/545
2013/0194245 A1* 8/2013 Ryu ..... G09G 3/3275 345/211

(Continued)

FOREIGN PATENT DOCUMENTS

JP 2013-186370 A 9/2013
KR 10-2004-0059037 A 7/2004

(Continued)

*Primary Examiner* — Fred Tzeng
(74) *Attorney, Agent, or Firm* — Knobbe Martens Olson & Bear LLP

(57) ABSTRACT

An organic light-emitting diode (OLED) display and a method of driving the same are disclosed. In one aspect, the OLED display includes a display panel including a plurality of pixels each including an OLED through which driving current is configured to flow and a scan driver configured to apply a scan signal to the display panel. The display also includes a data driver configured to apply a data signal and a data comparison signal to the display panel, wherein the data comparison signal indicates whether the same data signal is applied to adjacent pixels among the pixels, and a timing controller configured to control the scan driver and the data driver. The display further includes a bridge unit configured to control the OLEDs of the adjacent pixels to share the same driving current with each other based at least in part on the scan signal and the data comparison signal.

21 Claims, 24 Drawing Sheets

(56) References Cited

U.S. PATENT DOCUMENTS

2013/0235021 A1 9/2013 Maeda

FOREIGN PATENT DOCUMENTS

KR 10-2005-0052033 A 6/2005
KR 10-2006-0061835 A 6/2006

* cited by examiner

ORGANIC LIGHT-EMITTING DIODE DISPLAY AND METHOD OF DRIVING THE SAME

CROSS-REFERENCE TO RELATED APPLICATIONS

This application claims priority under 35 USC §119 to Korean Patent Applications No. 10-2014-0042954, filed on Apr. 10, 2014 in the Korean Intellectual Property Office (KIPO), the contents of which are incorporated herein in its entirety by reference.

BACKGROUND

Field

The described technology generally relates to an organic light-emitting diode display and a method of driving the same.

Description of the Related Technology

Since organic light-emitting diode (OLED) displays use OLEDs that generate light, they do not need a separate light source (e.g., backlight unit), unlike liquid crystal displays (LCDs). Thus, the OLED display can be relatively thin and light. In addition, OLED displays can have favorable characteristics such as low power consumption, improved luminance, improved response speed, etc. compared to LCDs. Hence, OLED displays are widely used in a display for electronic devices.

SUMMARY OF CERTAIN INVENTIVE ASPECTS

One inventive aspect is an OLED display that can prevent luminance non-uniformity due to luminance distribution of pixels included in the OLED display.

Another aspect is a method of driving the OLED display.

Another aspect is an OLED display that includes a display panel including a plurality of pixels, a scan driver configured to apply a scan signal to the display panel, a data driver configured to apply a data signal and a data comparison signal to the display panel, the data comparison signal indicating whether the same data signal is applied to adjacent pixels among the pixels, a timing controller configured to control the scan driver and the data driver, and a bridge unit configured to control a driving current sharing operation for driving currents flowing through OLEDs of the adjacent pixels based on the scan signal and the data comparison signal.

In example embodiments, the bridge unit determines that a first data signal applied to a first pixel is substantially the same as a second data signal applied to a second pixel that is adjacent to the first pixel when a difference between the first data signal and the second data signal is within a predetermined range.

In example embodiments, the bridge unit controls the driving current sharing operation either between horizontally adjacent pixels or between vertically adjacent pixels.

In example embodiments, the bridge unit controls the driving current sharing operation between horizontally adjacent pixels and between vertically adjacent pixels.

In example embodiments, the bridge unit includes a bridge control block configured to receive the scan signal and the data comparison signal and to output a bridge control signal corresponding to a switch turn-on voltage or a switch turn-off voltage based on the scan signal and the data comparison signal, and a bridge driving block configured to connect or separate anodes of the OLEDs of the adjacent pixels to each other based at least in part on the bridge control signal.

In example embodiments, the bridge unit connects the anodes of the OLEDs of the adjacent pixels to each other when the same data signal is applied to the adjacent pixels. In addition, the bridge unit can separate the anodes of the OLEDs of the adjacent pixels from each other when the same data signal is not applied to the adjacent pixels.

In example embodiments, each of the pixels includes a red color sub-pixel configured to output red color light based on the scan signal and the data signal, the red color sub-pixel including a first OLED, a green color sub-pixel configured to output green color light based on the scan signal and the data signal, the green color sub-pixel including a second OLED, and a blue color sub-pixel configured to output blue color light based on the scan signal and the data signal, the blue color sub-pixel including a third OLED.

In example embodiments, the bridge driving block includes a first switch configured to connect or separate anodes of the first OLEDs of the adjacent pixels to each other based at least in part on the bridge control signal, a second switch configured to connect or separate anodes of the second OLEDs of the adjacent pixels to each other based at least in part on the bridge control signal, and a third switch configured to connect or separate anodes of the third OLEDs of the adjacent pixels to each other based at least in part on the bridge control signal.

In example embodiments, the bridge control block includes a first bridge control block configured to provide a first bridge control signal for turning-on or turning-off the first switch, a second bridge control block configured to provide a second bridge control signal for turning-on or turning-off the second switch, and a third bridge control block configured to provide a third bridge control signal for turning-on or turning-off the third switch.

In example embodiments, each of the first through third bridge control blocks includes a transistor including a gate electrode that receives the scan signal and a source electrode that receives the data signal, and a capacitive element including a first electrode coupled to a drain electrode of the transistor and a second electrode coupled to a bridge control reference voltage.

In example embodiments, the OLED display further includes a demultiplexer unit configured to alternately apply the data signal to the red color sub-pixel, the green color sub-pixel, and the blue color sub-pixel in a time division technique based at least in part on the colors, the demultiplexer unit being located between the display panel and the data driver.

In example embodiments, each of the pixels includes a red color sub-pixel configured to output red color light based on the scan signal and the data signal, the red color sub-pixel including a first OLED, a green color sub-pixel configured to output green color light based on the scan signal and the data signal, the green color sub-pixel including a second OLED, a blue color sub-pixel configured to output blue color light based on the scan signal and the data signal, the blue color sub-pixel including a third OLED, and a white color sub-pixel configured to output white color light based on the scan signal and the data signal, the white color sub-pixel including a fourth OLED.

In example embodiments, the bridge driving block includes a first switch configured to connect or separate anodes of the first OLEDs of the adjacent pixels to each other based at least in part on the bridge control signal, a second switch configured to connect or separate anodes of the second OLEDs of the adjacent pixels to each other based at least in part on the bridge control signal, a third switch configured to connect or separate anodes of the third OLEDs of the adjacent pixels to each other based at least in part on the bridge control signal, and a fourth switch configured to connect or separate anodes of the fourth OLEDs of the adjacent pixels to each other based at least in part on the bridge control signal.

In example embodiments, the bridge control block includes a first bridge control block configured to provide a first bridge control signal for turning-on or turning-off the first switch, a second bridge control block configured to provide a second bridge control signal for turning-on or turning-off the second switch, a third bridge control block configured to provide a third bridge control signal for turning-on or turning-off the third switch, and a fourth bridge control block configured to provide a fourth bridge control signal for turning-on or turning-off the fourth switch.

In example embodiments, each of the first through fourth bridge control blocks includes a transistor including a gate electrode that receives the scan signal and a source electrode that receives the data signal, and a capacitive element including a first electrode coupled to a drain electrode of the transistor and a second electrode coupled to a bridge control reference voltage.

In example embodiments, the OLED display further includes a demultiplexer unit configured to alternately apply the data signal to the red color sub-pixel, the green color sub-pixel, the blue color sub-pixel, and the white color sub-pixel in a time division technique according to colors, the demultiplexer unit being located between the display panel and the data driver.

In example embodiments, the pixels are grouped based on locations of the pixels on the display panel to constitute a plurality of pixel groups, and the driving current sharing operation is performed in each of the pixel groups.

Another aspect is a method of driving an OLED display that includes an operation of detecting adjacent pixels to which the same data signal is applied among a plurality of pixels included in the OLED display, and an operation of controlling the adjacent pixels to share driving currents flowing through OLEDs of the adjacent pixels.

In example embodiments, a first data signal applied to a first pixel is determined to be substantially the same as a second data signal applied to a second pixel that is adjacent to the first pixel when a difference between the first data signal and the second data signal is within a predetermined range.

In example embodiments, the driving currents flowing through the OLEDs are shared when anodes of the OLEDs of the adjacent pixels are connected to each other.

Another aspect is an organic light-emitting diode (OLED) display, comprising a display panel including a plurality of pixels each including an OLED through which driving current is configured to flow and a scan driver configured to apply a scan signal to the display panel. The display also includes a data driver configured to apply a data signal and a data comparison signal to the display panel, wherein the data comparison signal indicates whether the same data signal is applied to adjacent pixels among the pixels, and a timing controller configured to control the scan driver and the data driver. The display further comprises a bridge unit configured to control the OLEDs of the adjacent pixels to share the same driving current with each other based at least in part on the scan signal and the data comparison signal.

In the above display, the pixels include a first pixel and a second pixel adjacent to the first pixel, and wherein the bridge unit is further configured to determine whether a first data signal applied to the first pixel is substantially the same as a second data signal applied to the second pixel when the difference between the first and second data signals is within a predetermined range.

In the above display, the adjacent pixels can be substantially horizontal to each other.

In the above display, the adjacent pixels can be substantially vertical to each other.

In the above display, the bridge unit includes a bridge control block configured to i) receive the scan signal and the data comparison signal and ii) output a bridge control signal corresponding to a switch turn-on voltage or a switch turn-off voltage based at least in part on the scan signal and the data comparison signal. In the above display, the bridge unit also includes a bridge driving block configured to electrically connect or disconnect the anodes of the OLEDs of the adjacent pixels to each other based at least in part on the bridge control signal.

In the above display, the bridge unit is further configured to electrically connect the anodes to each other when the same data signal is applied to the adjacent pixels, wherein the bridge unit is further configured to electrically disconnect the anodes from each other when the same data signal is not applied to the adjacent pixels.

In the above display, each of the pixels includes a red color sub-pixel configured to output red color light based at least in part on the scan signal and the data signal, wherein the red color sub-pixel includes a first OLED, a green color sub-pixel configured to output green color light based at least in part on the scan signal and the data signal, wherein the green color sub-pixel includes a second OLED, and a blue color sub-pixel configured to output blue color light based at least in part on the scan signal and the data signal, wherein the blue color sub-pixel includes a third OLED.

In the above display, the bridge driving block includes a first switch configured to electrically connect or disconnect the anodes of the first OLEDs of the adjacent pixels to each other based at least in part on the bridge control signal, a second switch configured to electrically connect or disconnect the anodes of the second OLEDs of the adjacent pixels to each other based at least in part on the bridge control signal, and a third switch configured to electrically connect or disconnect the anodes of the third OLEDs of the adjacent pixels to each other based at least in part on the bridge control signal.

In the above display, the bridge control block includes a first bridge control block configured to provide a first bridge control signal, wherein the first bridge control signal is configured to turn-on or turn-off the first switch, a second bridge control block configured to provide a second bridge control signal, wherein the second bridge control signal is configured to turn-on or turn-off the second switch, and a third bridge control block configured to provide a third bridge control signal, wherein the third bridge control signal is configured to turn-on or turn-off the third switch.

In the above display, each of the first through third bridge control blocks includes a transistor including a drain electrode and a gate electrode configured to receive the scan signal and a source electrode configured to receive the data signal and a capacitive element including a first electrode electrically connected to the drain electrode and a second electrode configured to receive to a bridge control reference voltage.

The above display further comprises a demultiplexer configured to alternately apply the data signal to the red, green and blue color sub-pixels in a time division technique based at least in part on colors, wherein the demultiplexer is located between the display panel and the data driver.

In the above display, each of the pixels includes a red color sub-pixel including a first OLED and configured to output red color light based at least in part on the scan signal and the data signal, a green color sub-pixel including a second OLED and configured to output green color light based at least in part on the scan signal and the data signal, a blue color sub-pixel including a third OLED and configured to output blue color light based at least in part on the scan signal and the data signal, and a white color sub-pixel including a fourth OLED and configured to output white color light based at least in part on the scan signal and the data signal.

In the above display, the bridge driving block includes a first switch configured to electrically connect or disconnect the anodes of the first OLEDs of the adjacent pixels to each other based at least in part on the bridge control signal, a second switch configured to electrically connect or disconnect the anodes of the second OLEDs of the adjacent pixels to each other based at least in part on the bridge control signal, a third switch configured to electrically connect or disconnect the anodes of the third OLEDs of the adjacent pixels to each other based at least in part on the bridge control signal, and a fourth switch configured to electrically connect or disconnect the anodes of the fourth OLEDs of the adjacent pixels to each other based at least in part on the bridge control signal.

In the above display, the bridge control block includes a first bridge control block configured to provide a first bridge control signal, wherein the first bridge control signal is configured to turn-on or turn-off the first switch, a second bridge control block configured to provide a second bridge control signal, wherein the second bridge control signal is configured to turn-on or turn-off the second switch, a third bridge control block configured to provide a third bridge control signal, wherein the third bridge control signal is configured to turn-on or turn-off the third switch, and a fourth bridge control block configured to provide a fourth bridge control signal, wherein the fourth bridge control signal is configured to turn-on or turn-off the fourth switch.

In the above display, each of the first through fourth bridge control blocks includes a transistor including a drain electrode, a gate electrode configured to receive the scan signal and a source electrode configured to receive the data signal. In the above display, each of the first through fourth bridge control blocks also includes a capacitive element including a first electrode electrically connected to the drain electrode and a second electrode electrically connected to a bridge control reference voltage.

The above display further comprises a demultiplexer configured to alternately apply the data signal to the red, green, blue and white color sub-pixels in a time division technique based at least in part on the colors, wherein the demultiplexer is located between the display panel and the data driver.

In the above display, the pixels are grouped based at least in part on locations of the pixels on the display panel so as to form a plurality of pixel groups, wherein the bridge unit is further configured to control the shared driving currents in each of the pixel groups.

Another aspect is a method of driving an organic light-emitting diode (OLED) display including a plurality of pixels, the method comprising detecting adjacent pixels among the pixels to which the same data signal is applied, wherein each pixel includes an OLED and controlling the adjacent pixels to share driving currents flowing through the OLEDs of the adjacent pixels with each other.

In the above method, the adjacent pixels include a first pixel and a second pixel, wherein a first data signal applied to the first pixel is determined to be substantially the same as a second data signal applied to the second pixel when the difference between the first and second data signals is within a predetermined range.

In the above method, the driving currents are shared when the anodes of the OLEDs of the adjacent pixels are electrically connected to each other.

According to at least one of the disclosed embodiments, the OLED display generates a data comparison signal indicating whether the same data signal is applied to adjacent pixels, and connects anodes of OLEDs of adjacent pixels that receive the same data signal to each other based on the data comparison signal. As a result, since adjacent pixels that receive the same data signal share driving currents flowing through OLEDs, the OLED display can efficiently prevent luminance non-uniformity due to luminance distribution of pixels included in the OLED display.

In addition, a method of driving an OLED display can determine whether the same data signal is applied to adjacent pixels, and can control adjacent pixels that receive the same data signal to share driving currents flowing through OLEDs. As a result, the method can improve luminance uniformity of the OLED display.

DETAILED DESCRIPTION OF CERTAIN INVENTIVE EMBODIMENTS

Generally, each pixel of an OLED display includes an OLED and a pixel circuit unit that controls a current (i.e., referred to as a driving current) flowing through the OLED. Here, since the OLED emits light based on the driving current, luminance of each pixel can be proportional to the driving current. However, due to a difference in characteristics of pixel circuit units, driving currents of pixels included in the OLED display can differ under the same condition (i.e., resulting in luminance distribution). As a result, luminance non-uniformity (e.g., Mura effect, stain, etc.) can be caused by the luminance distribution.

To overcome the above problem, typical techniques compensate the luminance non-uniformity by compensating threshold voltages of transistors included in each pixel (e.g., by controlling a driving transistor to be diode-coupled). However, since these techniques do not compensate the luminance non-uniformity caused by various factors (e.g., mobility, dynamic range, etc.) other than the threshold voltages of the elements, the luminance non-uniformity can occur even after these techniques compensate the threshold voltages of the elements included in each pixel of the OLED display.

Hereinafter, embodiments will be explained in detail with reference to the accompanying drawings. In this disclosure, the term "substantially" includes the meanings of completely, almost completely or to any significant degree under some applications and in accordance with those skilled in the art. Moreover, "formed on" can also mean "formed over." The term "connected" can include an electrical connection.

Figure 1:
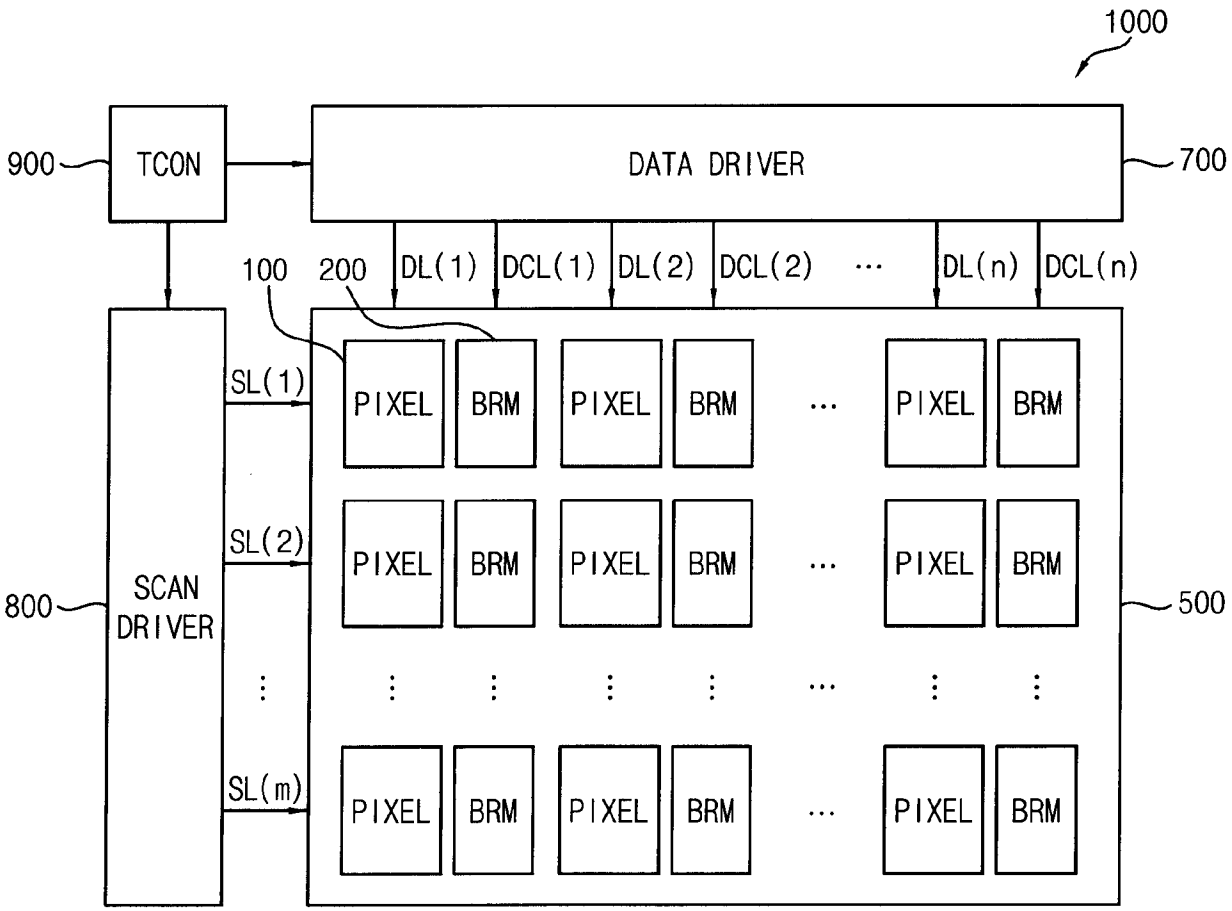
FIG. 1 is a block diagram illustrating an OLED display according to example embodiments.

FIG. 1 is a block diagram illustrating an OLED display according to example embodiments.

Referring to FIG. 1, the organic light-emitting diode (OLED) display 1000 includes a display panel 500, a data driver 700, a scan driver 800, a timing controller (TCON) 900, and a bridge unit 200.

The display panel 500 includes a plurality of pixels 100. In addition, the display panel 500 can receive a scan signal from the scan driver 800 via a plurality of scan lines SL(1) through SL(m), receive a data signal from the data driver 700 via a plurality of data lines DL(1) through DL(n), and receive a data comparison signal from the data driver 700 via a plurality of data comparison signal lines DCL(1) through DCL(n). Here, the data comparison signal can have a first voltage level when the same data signal is applied to adjacent pixels 100, and can have a second voltage level when different data signals are applied to adjacent pixels 100, where the first voltage level is different from the second voltage level. Thus, the data comparison signal can indicate whether the same data signal is applied to adjacent pixels 100. The data driver 700 and the scan driver 800 can be controlled by the timing controller 900. The bridge unit 200 can receive the scan signal and the data comparison signal and can control a driving current sharing operation between adjacent pixels 100 based at least in part on the scan signal and the data comparison signal. That is, driving currents flowing through OLEDs of adjacent pixels 100 can be shared by the bridge unit 200.

For example, when the same data signal is applied to adjacent pixels 100, the data comparison signal for controlling the driving current sharing operation between adjacent pixels 100 can have the first voltage level. Thus, anodes of OLEDs of adjacent pixels 100 can be electrically connected to each other based at least in part on the data comparison signal having the first voltage level. As a result, since adjacent pixels 100 that receive the same data signal share driving currents flowing through OLEDs, the OLED display 1000 can efficiently prevent luminance non-uniformity due to luminance distribution of the pixels 100. On the other hand, when different data signals are applied to adjacent pixels 100, the data comparison signal for controlling the driving current sharing operation between adjacent pixels 100 can have the second voltage level. Thus, anodes of OLEDs of adjacent pixels 100 can be electrically separated (or, disconnected) from each other based at least in part on the data comparison signal having the second voltage level. As a result, in some embodiments, adjacent pixels 100 that receive different data signals do not share driving currents flowing through OLEDs.

Figure 2:
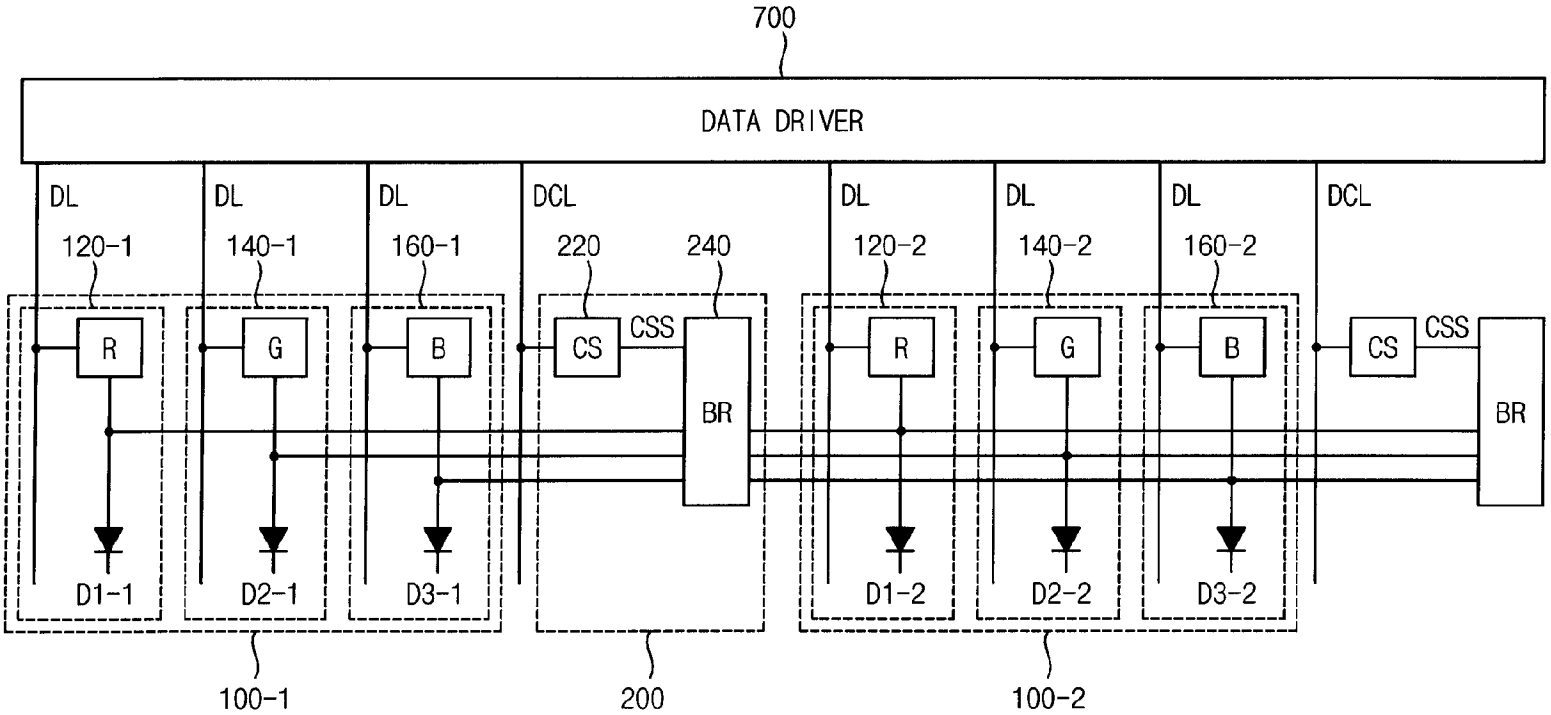
FIG. 2 is a diagram illustrating an example embodiment in which a red color sub-pixel, a green color sub-pixel, and a blue color sub-pixel are connected to a bridge unit in the OLED display of FIG. 1.

FIG. 2 is a diagram illustrating an example embodiment in which red, green and blue color sub-pixels are connected to a bridge unit in the OLED display 1000 of FIG. 1.

Referring to FIG. 2, each pixel 100-1 and 100-2 includes a red color sub-pixel 120-1 and 120-2, a green color sub-pixel 140-1 and 140-2, and a blue color sub-pixel 160-1 and 160-2. Here, the red color sub-pixel 120-1 and 120-2, the green color sub-pixel 140-1 and 140-2, and the blue color sub-pixel 160-1 and 160-2 can receive a data signal from the data driver 700 via the data line DL. The bridge unit 200 can include a bridge control block 220 and a bridge driving block 240. Here, the bridge control block 220 can receive a data comparison signal from the data driver 700 via the data comparison signal line DCL.

As illustrated in FIG. 2, the red color sub-pixels 120-1 and 120-2 of each pixel 100-1 and 100-2 include first OLEDs D1-1 and D1-2, and can emit red color light based at least in part on the scan signal and the data signal. The green color sub-pixel 140-1 and 140-2 of each pixel 100-1 and 100-2 can include second OLEDs D2-1 and D2-2, and can emit green color light based at least in part on the scan signal and the data signal. The blue color sub-pixel 160-1 and 160-2 of each pixel 100-1 and 100-2 can include third OLEDs D3-1 and D3-2, and can emit blue color light based at least in part on the scan signal and the data signal. In the red color sub-pixel 120-1 and 120-2 of each pixel 100-1 and 100-2, a driving current flowing through the first OLEDs D1-1 and D1-2 can be controlled by a red color pixel circuit unit R. In the green color sub-pixel 140-1 and 140-2 of each pixel 100-1 and 100-2, a driving current flowing through the second OLEDs D2-1 and D2-2 can be controlled by a green color pixel circuit unit G. In the blue color sub-pixel 160-1 and 160-2 of each pixel 100-1 and 100-2, a driving current flowing through the third OLEDs D3-1 and D3-2 can be controlled by a blue color pixel circuit unit B.

As described above, the bridge unit 200 can include the bridge control block 220 and the bridge driving block 240. The bridge control block 220 can receive the scan signal and the data comparison signal, and can output a bridge control signal CSS to the bridge driving block 240 based at least in part on the scan signal and the data comparison signal, where the bridge control signal CSS corresponds to a switch turn-on voltage or a switch turn-off voltage. The bridge driving block 240 can connect or separate (or, disconnect) anodes of OLEDs of adjacent pixels 110-1 and 110-2 to each other based at least in part on the bridge control signal CSS. For example, the bridge unit 200 can electrically connect anodes of OLEDs of adjacent pixels 100-1 and 100-2 to each other when the same data signal is applied to adjacent pixels 100-1 and 100-2. On the other hand, the bridge unit 200 can electrically separate anodes of OLEDs of adjacent pixels 100-1 and 100-2 from each other when different data signals are applied to adjacent pixels 100-1 and 100-2. In some embodiments, the bridge unit 200 determines that the same data signal is applied to adjacent pixels 100-1 and 100-2 if a difference between a data signal applied to the pixel 100-1 and a data signal applied to the pixel 100-2 is within a predetermined range. For example, the predetermined range is determined to be a range where adjacent pixels 100-1 and 100-2 result in (or, generate) substantially the same luminance.

As for internal operations of the bridge unit 200, when the same data signal is applied to adjacent pixels 100-1 and 100-2, the bridge control block 220 can adjust a voltage level of the bridge control signal CSS output to the bridge driving block 240. The bridge driving block 240 can receive the bridge control signal CSS. Here, when a data signal applied to the pixel 100-1 is substantially the same as a data signal applied to the pixel 100-2, the bridge driving block 240 can electrically connect an anode of the first OLED D1-1 to an anode of the first OLED D1-2, can electrically connect an anode of the second OLED D2-1 to an anode of the second OLED D2-2, and can electrically connect an anode of the third OLED D3-1 to an anode of the third OLED D3-2. As a result, a driving current of the red color sub-pixel 120-1 can become substantially equal to a driving current of the red color sub-pixel 120-2, a driving current of the green color sub-pixel 140-1 can become substantially equal to a driving current of the green color sub-pixel 140-2, and a driving current of the blue color sub-pixel 160-1 can become substantially equal to a driving current of the blue color sub-pixel 160-2. That is, luminance non-uniformity between adjacent pixels 100-1 and 100-2 can be prevented. In some embodiments, the bridge unit 200 controls a driving current sharing operation between adjacent pixels 100-1 and 100-2 that are horizontally adjacent to each other. In some embodiments, the bridge unit 200 can control a driving current sharing operation between adjacent pixels 100-1 and 100-2 that are vertically adjacent to each other. In some embodiments, the bridge unit 200 can control a driving current sharing operation between adjacent pixels 100-1 and 100-2 that are horizontally adjacent to each other and a driving current sharing operation between adjacent pixels 100-1 and 100-2 that are vertically adjacent to each other.

Figure 3:
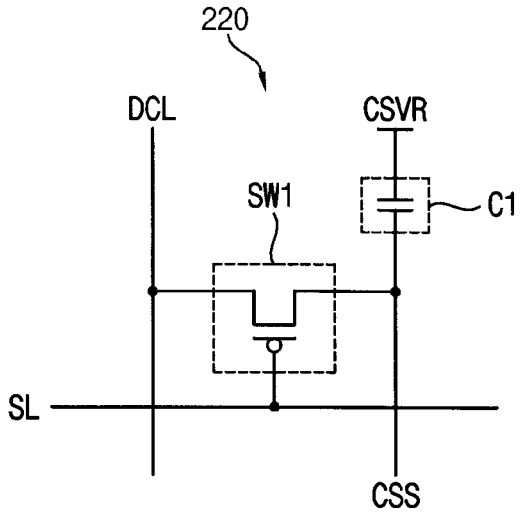
FIG. 3 is a diagram illustrating an example of a bridge control block of the bridge unit in FIG. 2.

FIG. 3 is a diagram illustrating an example of a bridge control block of the bridge unit in FIG. 2.

Referring to FIG. 3, the bridge control block 220 includes a transistor SW1 and a capacitive element C1.

The transistor SW1 can include a gate electrode that receives the scan signal via the scan line SL, a source electrode that receives the data comparison signal via the data comparison signal line DCL, and a drain electrode that is connected to a first electrode of the capacitive element C1. The capacitive element C1 can include the first electrode that is connected to the drain electrode of the transistor SW1 and a second electrode that is connected to a bridge control reference voltage CSVR. For example, when the data comparison signal is applied from the data driver 700 via the data comparison signal line DCL, the transistor SW1 is turned-on based at least in part on the scan signal that is applied from the scan driver 800 via the scan line SL. When the transistor SW1 is turned-on, the data comparison signal can be output at the drain electrode of the transistor SW1. The first electrode of the capacitive element C1 can be connected to the drain electrode of the transistor SW1. Thus, the capacitive element C1 can receive the data comparison signal when the transistor SW1 is turned-on. The second electrode of the capacitive element C1 can be connected to the bridge control reference voltage CSVR. Thus, the capacitive element C1 can store a voltage level of the data comparison signal. The data comparison signal stored in the capacitive element C1 can be output to the bridge driving block 240 as the bridge control signal CSS.

Figure 4:
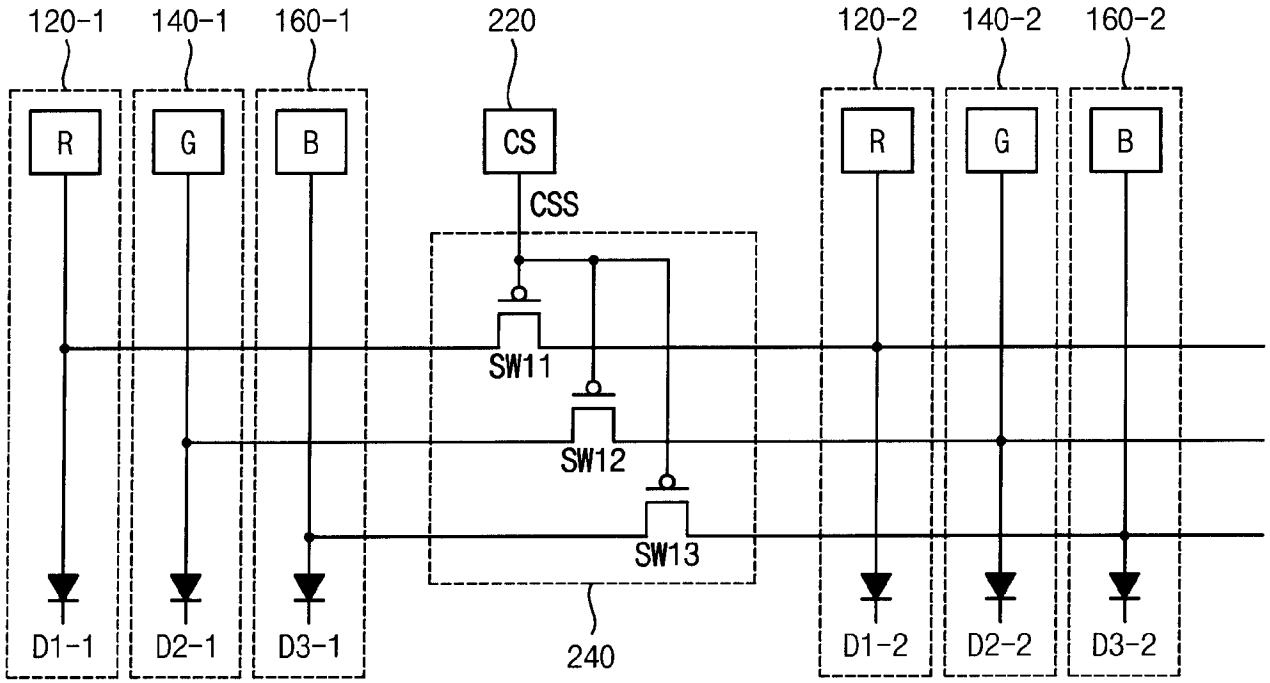
FIG. 4 is a diagram illustrating a detailed structure of the bridge unit in FIG. 2.

FIG. 4 is a diagram illustrating a detailed structure of the bridge unit in FIG. 2.

Referring to FIG. 4, the bridge driving block 240 includes first to third switches SW11 to SW13. The first switch SW11 can connect or separate anodes of the first OLEDs D1-1 and D1-2 of adjacent pixels 100-1 and 100-2 to each other based at least in part on the bridge control signal CSS. The second switch SW12 can connect or separate anodes of the second OLEDs D2-1 and D2-2 of adjacent pixels 100-1 and 100-2 to each other based at least in part on the bridge control signal CSS. The third switch SW13 can connect or separate anodes of the third OLEDs D3-1 and D3-2 of adjacent pixels 100-1 and 100-2 to each other based at least in part on the bridge control signal CSS.

The bridge driving block 240 can turn-on or turn-off the first to third switches SW11 to SW13 by receiving the bridge control signal CSS from the bridge control block 220. When the same data signal is applied to adjacent pixels 110-1 and 110-2, the first through third switches SW11 through SW13 can be turned-on. Thus, an anode of the first OLED D1-1 can be electrically connected to an anode of the first OLED D1-2, an anode of the second OLED D2-1 can be electrically connected to an anode of the second OLED D2-2, and an anode of the third OLED D3-1 can be electrically connected to an anode of the third OLED D3-2. In this case, the first OLEDs D1-1 and D1-2 can share driving currents, the second OLEDs D2-1 and D2-2 can share driving currents, and the third OLEDs D3-1 and D3-2 can share driving currents.

On the other hand, when different data signals are applied to adjacent pixels 100-1 and 100-2, the first through third switches SW11 through SW13 can be turned-off. Thus, an anode of the first OLED D1-1 can be electrically separated from an anode of the first OLED D1-2, an anode of the second OLED D2-1 can be electrically separated from an anode of the second OLED D2-2, and an anode of the third OLED D3-1 can be electrically separated from an anode of the third OLED D3-2. As a result, in some embodiments, the first OLEDs D1-1 and D1-2 do not share driving currents, the second OLEDs D2-1 and D2-2 do not share driving currents, and the third OLEDs D3-1 and D3-2 do not share driving currents. That is, when different data signals are applied to adjacent pixels 100-1 and 100-2, the first through third OLEDs D1-1, D2-1, and D3-1 can operate (i.e., emit light) independently and separately from the first through third OLEDs D1-2, D2-2, and D3-2.

Figure 5:
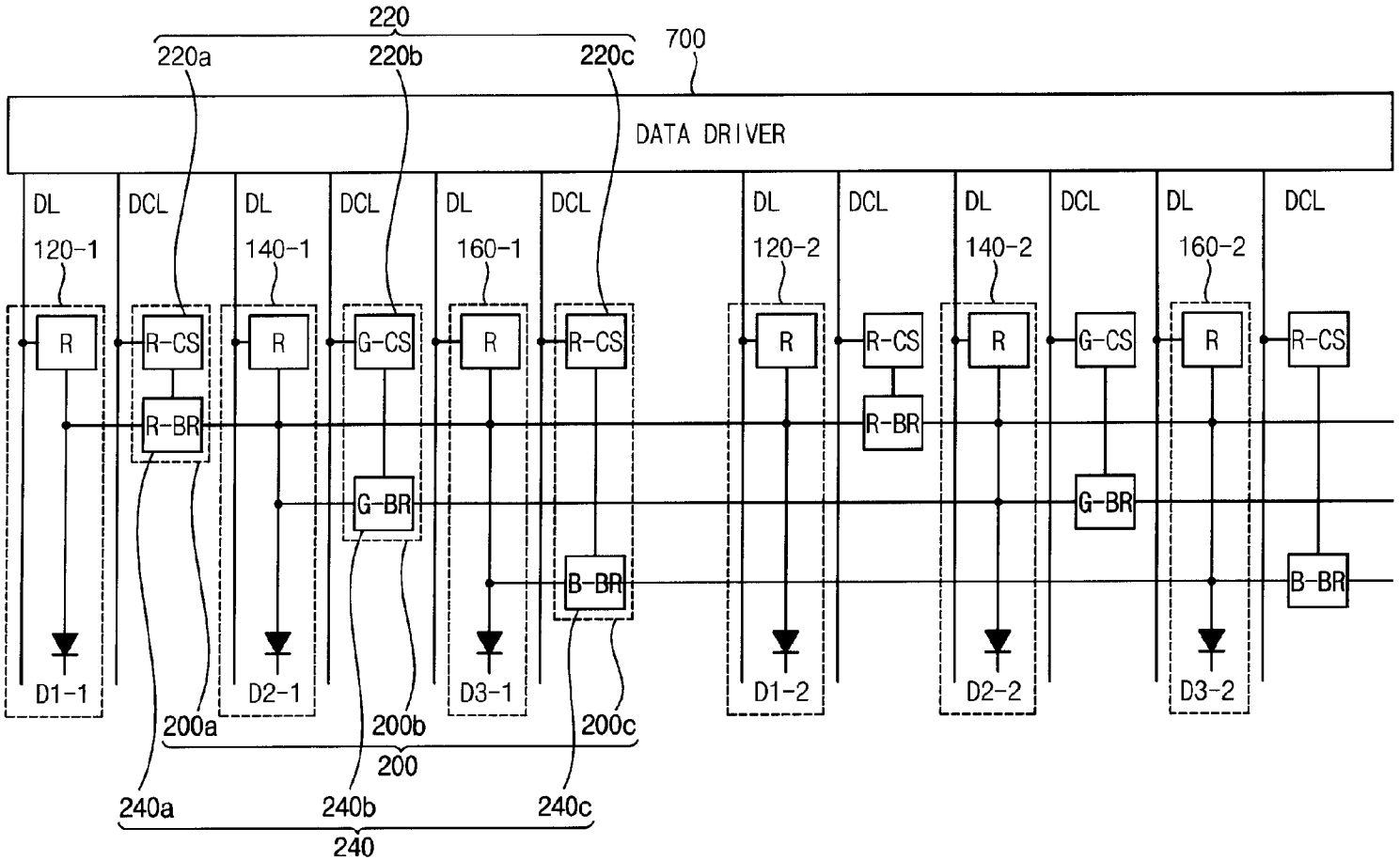
FIG. 5 is a diagram illustrating another example embodiment in which a red color sub-pixel, a green color sub-pixel, and a blue color sub-pixel are connected to a bridge unit in the OLED display of FIG. 1.
Figure 6:
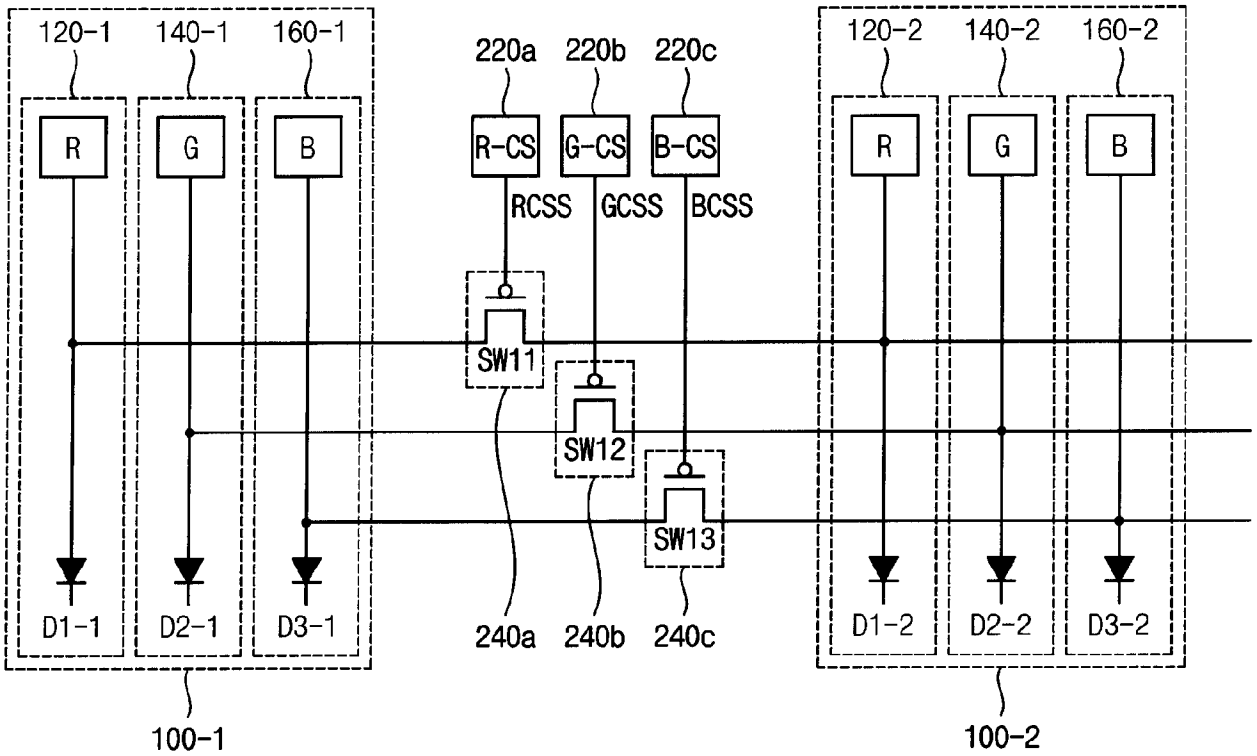
FIG. 6 is a diagram illustrating a detailed structure of the bridge unit in FIG. 5.

FIG. 5 is a diagram illustrating another example embodiment in which red, green and blue color sub-pixels are connected to a bridge unit in the OLED display 1000 of FIG. 1. FIG. 6 is a diagram illustrating a detailed structure of the bridge unit in FIG. 5.

Referring to FIGS. 5 and 6, each pixel 100-1 and 100-2 includes a red color sub-pixel 120-1 and 120-2, a green color sub-pixel 140-1 and 140-2, and a blue color sub-pixel 160-1 and 160-2. Here, the red color sub-pixel 120-1 and 120-2, the green color sub-pixel 140-1 and 140-2, and the blue color sub-pixel 160-1 and 160-2 can receive the data signal from the data driver 700 via the data line DL. The bridge unit 200 can include the bridge control block 220 and the bridge driving block 240. Here, the bridge control block 220 can receive the data comparison signal from the data driver 700 via the data comparison signal line DCL.

As illustrated in FIG. 6, the bridge driving block 240 includes first to third bridge driving blocks 240*a* to 240*c*. The first bridge driving block 240*a* can connect or separate anodes of the first OLEDs D1-1 and D1-2 of adjacent pixels 100-1 and 100-2 to each other. The second bridge driving block 240*b* can connect or separate anodes of the second OLEDs D2-1 and D2-2 of adjacent pixels 100-1 and 100-2 to each other. The third bridge driving block 240*c* can connect or separate anodes of the third OLEDs D3-1 and D3-2 of adjacent pixels 100-1 and 100-2 to each other. Here, the first bridge driving block 240*a* can include a first switch SW11, the second bridge driving block 240*b* can include a second switch SW12, and the third bridge driving block 240*c* can include a third switch SW13. The bridge control block 220 can include first to third bridge control blocks 220*a* to 220*c*. The first bridge control block 220*a* can provide a first bridge control signal RCSS for controlling the first switch SW11 to be turned-on or turned-off. The second bridge control block 220*b* can provide a second bridge control signal GCSS for controlling the second switch SW12 to be turned-on or turned-off. The third bridge control block 220*c* can provide a third bridge control signal BCSS for controlling the third switch SW13 to be turned-on or turned-off.

When the same data signal corresponding to red color data (i.e., data for outputting red color light) is applied to adjacent pixels 100-1 and 100-2, the first switch SW11 can be turned-on by the first bridge control signal RCSS output from the first bridge control block 220*a*. Thus, anodes of the first OLEDs D1-1 and D1-2 of adjacent pixels 100-1 and 100-2 can be electrically connected to each other. When the same data signal corresponding to green color data (i.e., data for outputting green color light) is applied to adjacent pixels 100-1 and 100-2, the second switch SW12 can be turned-on by the second bridge control signal GCSS output from the second bridge control block 220*b*. Thus, anodes of the second OLEDs D2-1 and D2-2 of adjacent pixels 100-1 and 100-2 can be electrically connected to each other. When the same data signal corresponding to blue color data (i.e., data for outputting blue color light) is applied to adjacent pixels 100-1 and 100-2, the third switch SW13 can be turned-on by the third bridge control signal BCSS output from the third bridge control block 220*c*. Thus, anodes of the third OLEDs D3-1 and D3-2 of adjacent pixels 100-1 and 100-2 can be electrically connected to each other. As a result, the first OLEDs D1-1 and D1-2 can share driving currents when the first switch SW11 is turned-on, the second OLEDs D2-1 and D2-2 can share driving currents when the second switch SW12 is turned-on, and the third OLEDs D3-1 and D3-2 can share driving currents when the third switch SW13 is turned-on. As described above, the red, green and blue color sub-pixels of adjacent pixels 100-1 and 100-2 can respectively perform a driving current sharing operation.

On the other hand, when different data signals are applied to adjacent pixels 100-1 and 100-2, the first switch SW11 can be turned-off. Thus, an anode of the first OLED D1-1 can be electrically separated from an anode of the first OLED D1-2. When different data signals are applied to adjacent pixels 100-1 and 100-2, the second switch SW12 can be turned-off. Thus, an anode of the second OLED D2-1 can be electrically separated from an anode of the second OLED D2-2. When different data signals are applied to adjacent pixels 100-1 and 100-2, the third switch SW13 can be turned-off. Thus, an anode of the third OLED D3-1 can be electrically separated from an anode of the third OLED D3-2. As a result, in some embodiments, the first OLEDs D1-1 and D1-2 do not share driving currents, the second OLEDs D2-1 and D2-2 do not share driving currents, and the third OLEDs D3-1 and D3-2 do not share driving currents. That is, when different data signals are applied to adjacent pixels 100-1 and 100-2, the first through third OLEDs D1-1, D2-1, and D3-1 can operate (i.e., emit light) independently and separately from the first through third OLEDs D1-2, D2-2, and D3-2.

Figure 7:
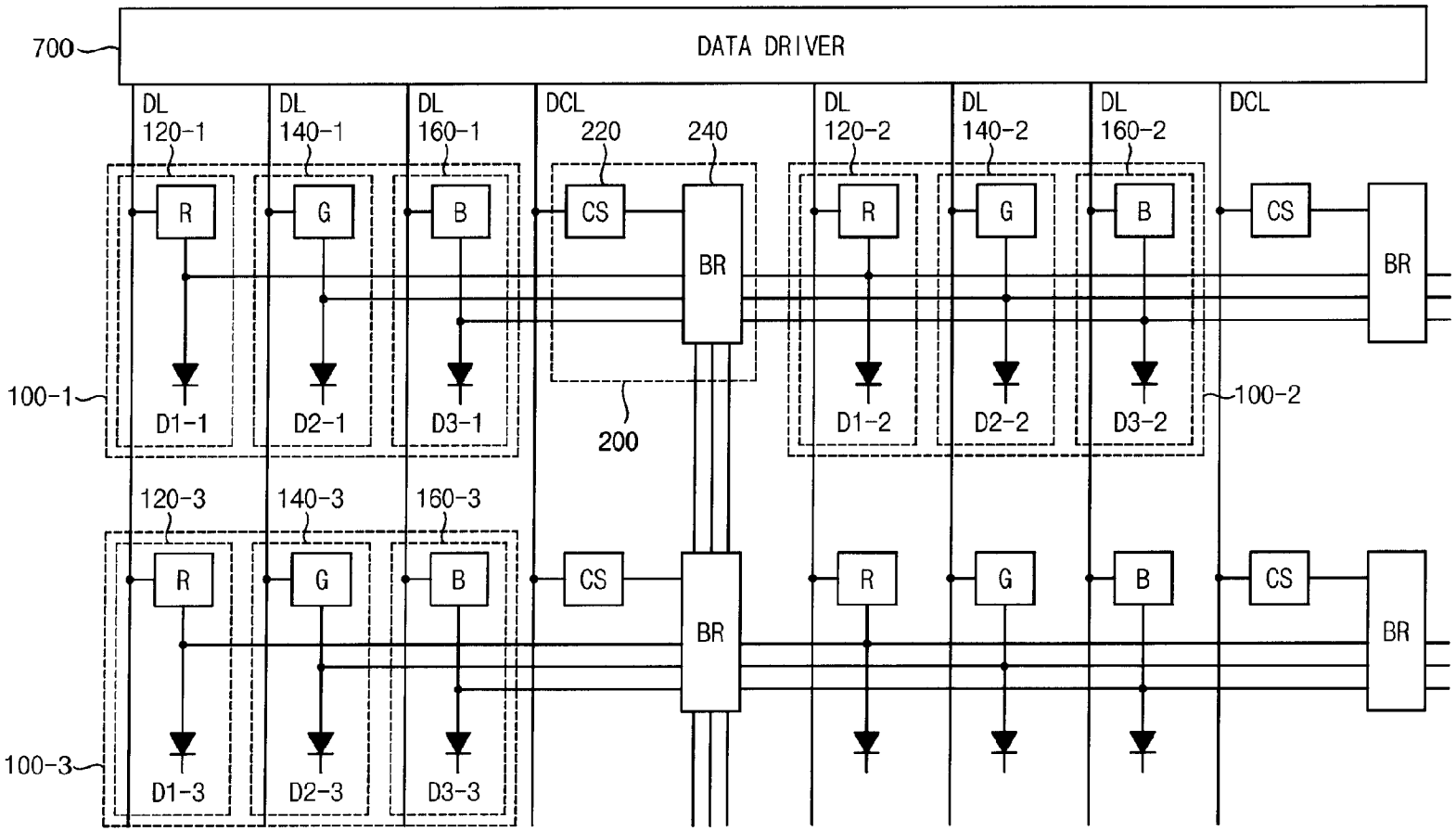
FIG. 7 is a diagram illustrating still another example embodiment in which a red color sub-pixel, a green color sub-pixel, and a blue color sub-pixel are connected to a bridge unit in the OLED display of FIG. 1.
Figure 8:
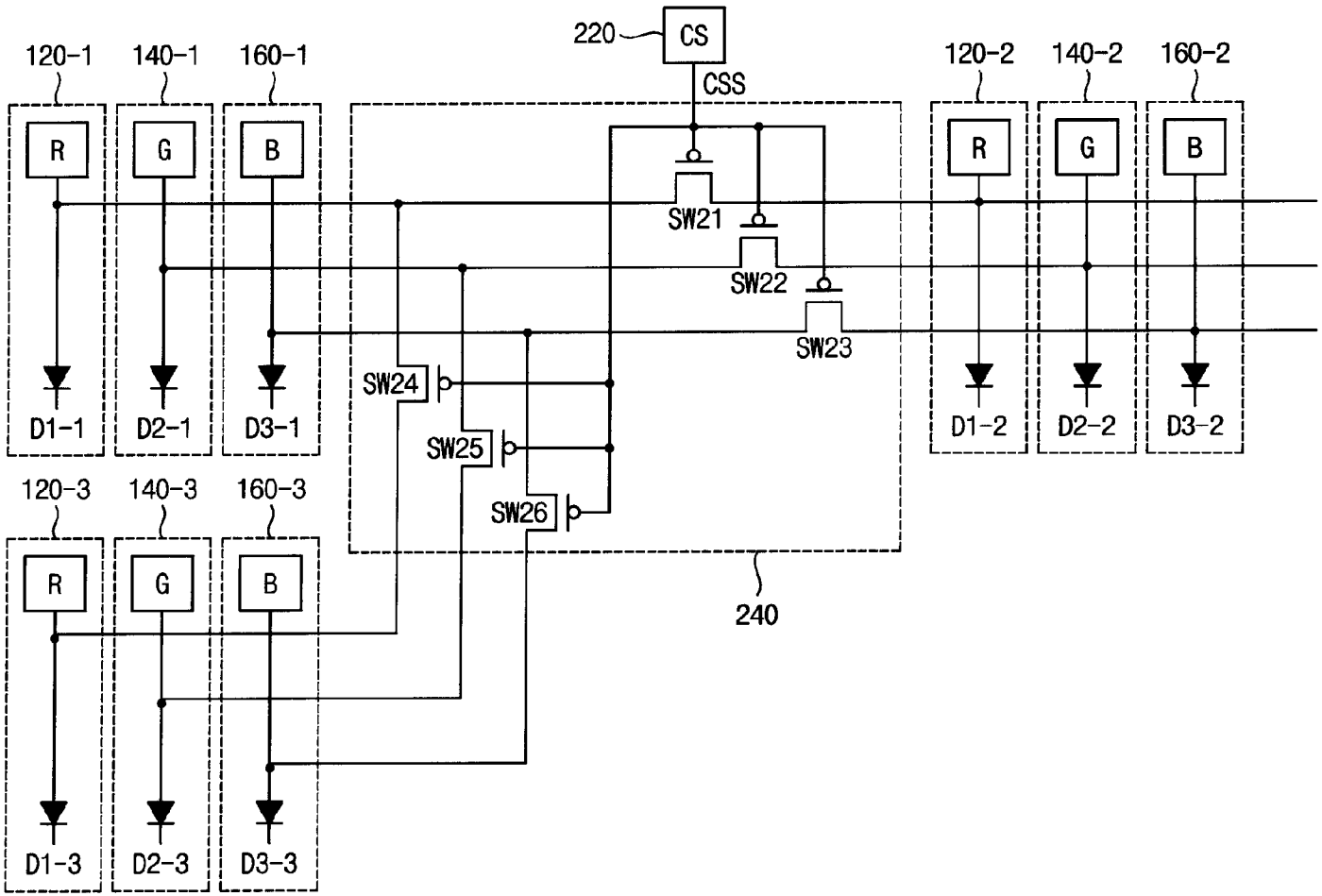
FIG. 8 is a diagram illustrating a detailed structure of the bridge unit in FIG. 7.

FIG. 7 is a diagram illustrating still another example embodiment in which red, green and blue color sub-pixel are connected to a bridge unit in the OLED display 1000 of FIG. 1. FIG. 8 is a diagram illustrating a detailed structure of the bridge unit in FIG. 7.

Referring to FIGS. 7 and 8, each pixel 100-1, 100-2, and 100-3 includes a red color sub-pixel 120-1, 120-2, and 120-3, a green color sub-pixel 140-1, 140-2, and 140-3, and a blue color sub-pixel 160-1, 160-2, and 160-3. Here, the red color sub-pixel 120-1, 120-2, and 120-3, the green color sub-pixel 140-1, 140-2, and 140-3, and the blue color sub-pixel 160-1, 160-2, and 160-3 can receive a data signal from the data driver 700 via the data line DL. The bridge unit 200 can include a bridge control block 220 and a bridge driving block 240. Here, the bridge control block 220 can receive a data comparison signal from the data driver 700 via the data comparison signal line DCL.

As illustrated in FIG. 8, the bridge driving block 240 includes first to third horizontal switches SW21 to SW23. The first horizontal switch SW21 can connect or separate anodes of the first OLEDs D1-1 and D1-2 of horizontally adjacent pixels 100-1 and 100-2 to each other based at least in part on the bridge control signal CSS. The second horizontal switch SW22 can connect or separate anodes of the second OLEDs D2-1 and D2-2 of horizontally adjacent pixels 100-1 and 100-2 to each other based at least in part on the bridge control signal CSS. The third horizontal switch SW23 can connect or separate anodes of the third OLEDs D3-1 and D3-2 of horizontally adjacent pixels 100-1 and 100-2 to each other based at least in part on the bridge control signal CSS. In addition, the bridge driving block 240 can include first to third vertical switches SW24 to SW26. The first vertical switch SW24 can connect or separate anodes of the first OLEDs D1-1 and D1-3 of vertically adjacent pixels 100-1 and 100-3 to each other based at least in part on the bridge control signal CSS. The second vertical switch SW25 can connect or separate anodes of the second OLEDs D2-1 and D2-3 of vertically adjacent pixels 100-1 and 100-3 to each other based at least in part on the bridge control signal CSS. The third vertical switch SW26 can connect or separate anodes of the third OLEDs D3-1 and D3-3 of vertically adjacent pixels 100-1 and 100-3 to each other based at least in part on the bridge control signal CSS. Each pixel 100-1, 100-2, and 100-3 can include the red color sub-pixel 120-1, 120-2, and 120-3, the green color sub-pixel 140-1, 140-2, and 140-3, and the blue color sub-pixel 160-1, 160-2, and 160-3. The red color sub-pixels 120-1, 120-2, and 120-3 can include the first OLEDs D1-1, D1-2, and D1-3, and can output a red color light based at least in part on the scan signal and the data signal. The green color sub-pixels 140-1, 140-2, and 140-3 can include the second OLEDs D2-1, D2-2, and D2-3, and can output a green color light based at least in part on the scan signal and the data signal. The blue color sub-pixels 160-1, 160-2, and 160-3 can include the third OLEDs D3-1, D3-2, and D3-3, and can output a blue color light based at least in part on the scan signal and the data signal.

When the same data signal is applied to horizontally adjacent pixels 100-1 and 100-2, the bridge unit 200 can connect anodes of the first OLEDs D1-1 and D1-2 to each other, can connect anodes of the second OLEDs D2-1 and D2-2 to each other, and can connect anodes of the third OLEDs D3-1 and D3-2 to each other. On the other hand, when different data signals are applied to horizontally adjacent pixels 100-1 and 100-2, the bridge unit 200 can separate anodes of the first OLEDs D1-1 and D1-2 from each other, can separate anodes of the second OLEDs D2-1 and D2-2 from each other, and can separate anodes of the third OLEDs D3-1 and D3-2 from each other. In addition, when the same data signal is applied to vertically adjacent pixels 100-1 and 100-3, the bridge unit 200 can connect anodes of the first OLEDs D1-1 and D1-3 to each other, connect anodes of the second OLEDs D2-1 and D2-3 to each other, and connect anodes of the third OLEDs D3-1 and D3-3 to each other. On the other hand, when different data signals are applied to vertically adjacent pixels 100-1 and 100-3, the bridge unit 200 can separate anodes of the first OLEDs D1-1 and D1-3 from each other, can separate anodes of the second OLEDs D2-1 and D2-3 from each other, and can separate anodes of the third OLEDs D3-1 and D3-3 from each other. That is, the bridge unit 200 can control a driving current sharing operation between horizontally adjacent pixels 100-1 and 100-2 and a driving current sharing operation between vertically adjacent pixels 100-1 and 100-3.

When the same data signal is applied to horizontally and vertically adjacent pixels 100-1, 100-2, and 100-3, the bridge control block 220 can adjust a voltage level of the bridge control signal CSS output to the bridge driving block 240. The bridge driving block 240 can receive the bridge control signal CSS. When the same data signal is applied to horizontally and vertically adjacent pixels 100-1, 100-2, and 100-3, the bridge driving block 240 can electrically connect anodes of the first OLEDs D1-1, D1-2, and D1-3 of the red color sub-pixels 120-1, 120-2, and 120-3 to each other, electrically connect anodes of the second OLEDs D2-1, D2-2, and D2-3 of the green color sub-pixels 140-1, 140-2, and 140-3 to each other, and electrically connect anodes of the third OLEDs D3-1, D3-2, and D3-3 of the blue color sub-pixels 160-1, 160-2, and 160-3 to each other.

For example, the bridge driving block 240 can receive the bridge control signal CSS from the bridge control block 220 to turn-on or turn-off the first to third horizontal switches SW21 to SW23 and the first to third vertical switches SW24 to SW26. When the same data signal is applied to horizontally and vertically adjacent pixels 100-1, 100-2, and 100-3, the first to third horizontal switches SW21 to SW23 and the first to third vertical switches SW24 to SW26 can be turned-on. For example, when the first third horizontal switch SW23 are turned-on, anodes of the first OLEDs D1-1 and D1-2 can be electrically connected to each other, anodes of the second OLEDs D2-1 and D2-2 can be electrically connected to each other, and anodes of the third OLEDs D3-1 and D3-2 can be electrically connected to each other. That is, driving currents can be shared between horizontally adjacent pixels 100-1 and 100-2. Similarly, when the first to third vertical switches SW24 to SW26 are turned-on, anodes of the first OLEDs D1-1 and D1-3 can be electrically connected to each other, anodes of the second OLEDs D2-1 and D2-3 can be electrically connected to each other, and anodes of the third OLEDs D3-1 and D3-3 can be electrically connected to each other. That is, driving currents can be shared between vertically adjacent pixels 100-1 and 100-3. As a result, driving currents of the red color sub-pixels 120-1 to 120-3 can become substantially equal to each other, driving currents of the green color sub-pixels to 140-3 can become substantially equal to each other, and driving current of the blue color sub-pixels 160-1 to 160-3 can become substantially equal to each other. As a result, luminance non-uniformity among horizontally and vertically adjacent pixels 100-1, 100-2, and 100-3 can be prevented or reduced.

On the other hand, when different data signals are applied to horizontally adjacent pixels 100-1 and 100-2 or when different data signals are applied to vertically adjacent pixels 100-1 and 100-3, the first to third horizontal switches SW21 to SW23 and the first to third vertical switches SW24 to SW26 can be turned-off. In this case, anodes of the first OLEDs D1-1 and D1-2 can be electrically separated from each other, anodes of the second OLEDs D2-1 and D2-2 can be electrically separated from each other, and anodes of the third OLEDs D3-1 and D3-2 can be electrically separated from each other. Thus, in some embodiments, the driving currents are not shared between horizontally adjacent pixels 100-1 and 100-2. In addition, anodes of the first OLEDs D1-1 and D1-3 can be electrically separated from each other, anodes of the second OLEDs D2-1 and D2-3 can be electrically separated from each other, and anodes of the third OLEDs D3-1 and D3-3 can be electrically separated from each other. Thus, in some embodiments, the driving currents are not shared between vertically adjacent pixels 100-1 and 100-3. As a result, when different data signals are applied to horizontally and vertically adjacent pixels 100-1, 100-2, and 100-3, the first through third OLEDs D1-1, D2-1, and D3-1, the first through third OLEDs D1-2, D2-2, and D3-2, and the first through third OLEDs D1-3, D2-3, and D3-3 can independently and separately operate.

Figure 9:
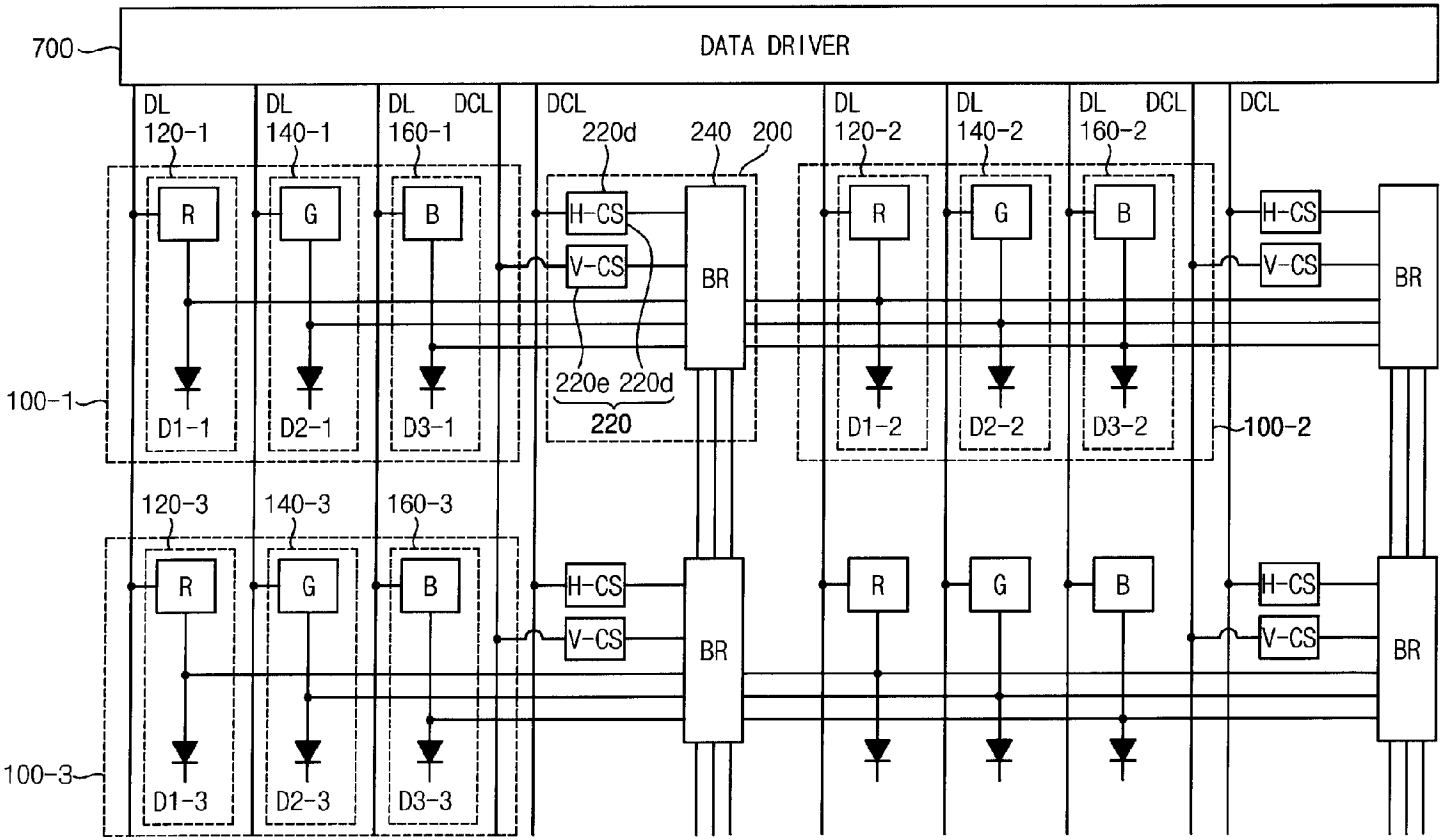
FIG. 9 is a diagram illustrating still another example embodiment in which a red color sub-pixel, a green color sub-pixel, and a blue color sub-pixel are connected to a bridge unit in the OLED display of FIG. 1.
Figure 10:
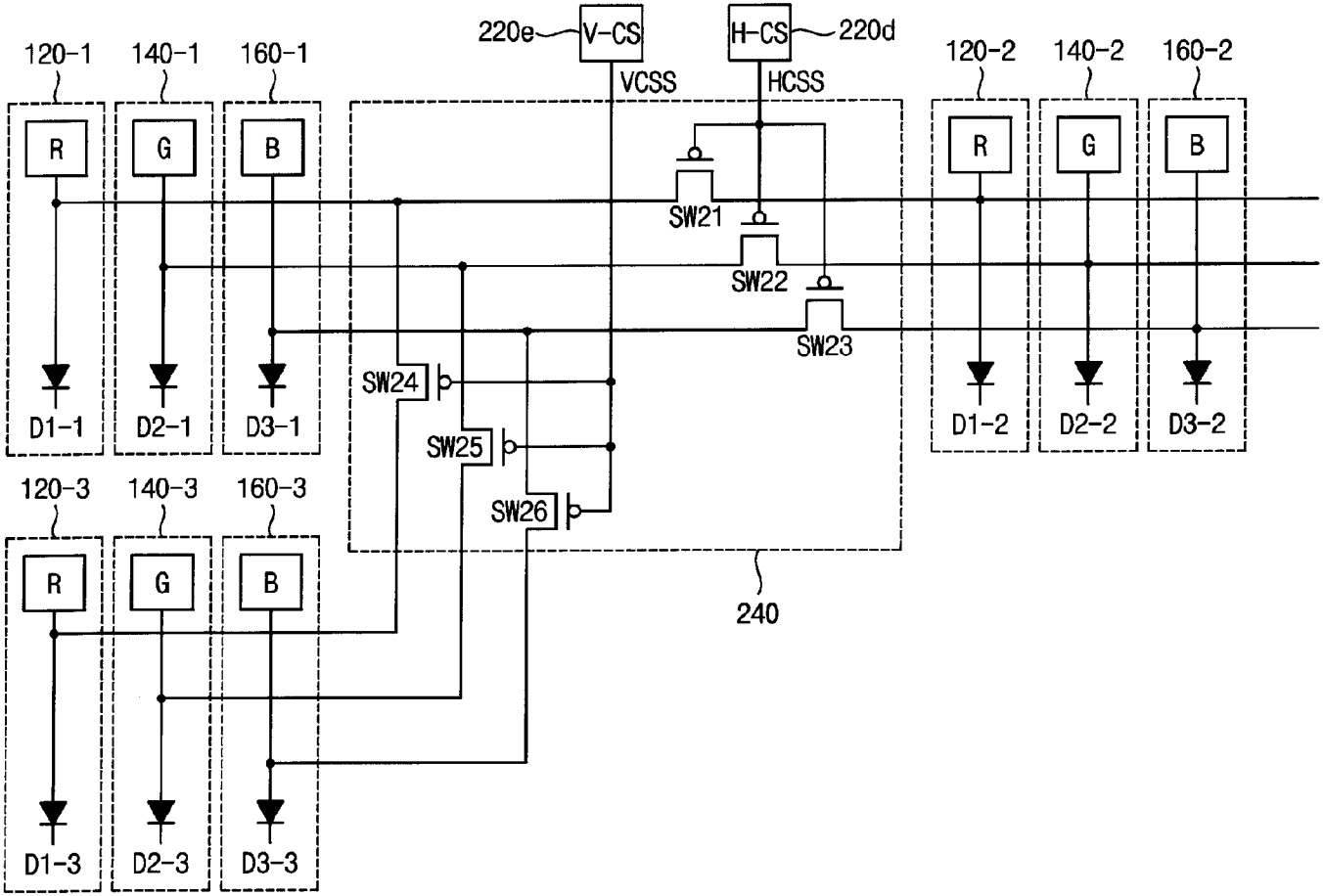
FIG. 10 is a diagram illustrating a detailed structure of the bridge unit in FIG. 9.

FIG. 9 is a diagram illustrating still another example embodiment in which red, green and blue color sub-pixels are connected to a bridge unit in the OLED display 1000 of FIG. 1. FIG. 10 is a diagram illustrating a detailed structure of the bridge unit in FIG. 9.

Referring to FIGS. 9 and 10, each pixel 100-1, 100-2, and 100-3 includes a red color sub-pixel 120-1, 120-2, and 120-3, a green color sub-pixel 140-1, 140-2, and 140-3, and a blue color sub-pixel 160-1, 160-2, and 160-3. Here, the red color sub-pixel 120-1, 120-2, and 120-3, the green color sub-pixel 140-1, 140-2, and 140-3, and the blue color sub-pixel 160-1, 160-2, and 160-3 can receive respective data signals from the data driver 700 via respective data lines DL. The bridge unit 200 includes a horizontal bridge control block 220*d*, a vertical bridge control block 220*e*, and a bridge driving block 240. Here, the horizontal bridge control block 220*d* and the vertical bridge control block 220*e* can receive a data comparison signal from the data driver 700 via a data comparison signal line DCL.

The bridge driving block 240 can include the first to third horizontal switches SW21 to SW23. The first horizontal switch SW21 can connect or separate anodes of first OLEDs D1-1 and D1-2 to each other based at least in part on a horizontal bridge control signal HCSS. The second horizontal switch SW22 can connect or separate anodes of second OLEDs D2-1 and D2-2 to each other based at least in part on the horizontal bridge control signal HCSS. The third horizontal switch SW23 can connect or separate anodes of third OLEDs D3-1 and D3-2 to each other based at least in part on the horizontal bridge control signal HCSS. In addition, the bridge driving block 240 can include the first to third vertical switches SW24 to SW26. The first vertical switch SW24 can connect or separate anodes of first OLEDs D1-1 and D1-3 to each other based at least in part on a vertical bridge control signal VCSS. The second vertical switch SW25 can connect or separate anodes of second OLEDs D2-1 and D2-3 to each other based at least in part on the vertical bridge control signal VCSS. The third vertical switch SW26 can connect or separate anodes of third OLEDs D3-1 and D3-3 to each other based at least in part on the vertical bridge control signal VCSS. Each pixel 100-1, 100-2, and 100-3 can include red color sub-pixels 120-1, 120-2, and 120-3, green color sub-pixels 140-1, 140-2, and 140-3, and blue color sub-pixels 160-1, 160-2, and 160-3. The red color sub-pixels 120-1, 120-2, and 120-3 can include the first OLEDs D1-1, D1-2, and D1-3, and can emit red color light based at least in part on the scan signal and the data signal. The green color sub-pixels 140-1, 140-2, and 140-3 can include the second OLEDs D2-1, D2-2, and D2-3, and can emit green color light based at least in part on the scan signal and the data signal. The blue color sub-pixels 160-1, 160-2, and 160-3 can include the third OLEDs D3-1, D3-2, and D3-3, and can emit blue color light based at least in part on the scan signal and the data signal.

When the same data signal is applied to horizontally adjacent pixels 100-1 and 100-2, the bridge unit 200 can connect the anodes of the first OLEDs D1-1 and D1-2 to each other, can connect the anodes of the second OLEDs D2-1 and D2-2 to each other, and can connect the anodes of the third OLEDs D3-1 and D3-2 to each other. On the other hand, when the same data signal is not applied to horizontally adjacent pixels 100-1 and 100-2, the bridge unit 200 can separate the anodes of the first OLEDs D1-1 and D1-2 from each other, separate the anodes of the second OLEDs D2-1 and D2-2 from each other, and separate the anodes of the third OLEDs D3-1 and D3-2 from each other. In addition, when the same data signal is applied to vertically adjacent pixels 100-1 and 100-3, the bridge unit 200 can connect the anodes of the first OLEDs D1-1 and D1-3 to each other, connect the anodes of the second OLEDs D2-1 and D2-3 to each other, and connect the anodes of the third OLEDs D3-1 and D3-3 to each other. On the other hand, when the same data signal is not applied to vertically adjacent pixels 100-1 and 100-3, the bridge unit 200 can separate the anodes of the first OLEDs D1-1 and D1-3 from each other, separate the anodes of the second OLEDs D2-1 and D2-3 from each other, and separate the anodes of the third OLEDs D3-1 and D3-3 from each other. That is, the bridge unit 200 can control a driving current sharing operation among adjacent pixels 100-1, 100-2, and 100-3 that are horizontally and vertically adjacent to each other.

For example, when the same data signal is applied to horizontally adjacent pixels 100-1 and 100-2, the horizontal bridge control block 220*d* can adjust a voltage level of the horizontal bridge control signal HCSS output to the bridge driving block 240. In addition, when the same data signal is applied to vertically adjacent pixels 100-1 and 100-3, the horizontal bridge control block 220*e* can adjust a voltage level of the vertical bridge control signal VCSS output to the bridge driving block 240. The bridge driving block 240 can receive the horizontal bridge control signal HCSS, and can electrically connect the anodes of the OLEDs D1-1 and D1-2 to each other, the anodes of the OLEDs D2-1 and D2-2 to each other, and the anodes of the OLEDs D3-1 and D3-2 to each other when the same data signal is applied to horizontally adjacent pixels 100-1 and 100-2. In addition, the bridge driving block 240 can receive the vertical bridge control signal VCSS, and can electrically connect the anodes of the OLEDs D1-1 and D1-3 to each other, the anodes of the OLEDs D2-1 and D2-3 to each other, and the anodes of the OLEDs D3-1 and D3-3 to each other when the same data signal is applied to vertically adjacent pixels 100-1 and 100-3.

As illustrated in FIG. 10, the bridge driving block 240 receives the horizontal bridge control signal HCSS from the horizontal bridge control block 220*d*, and turns-on or turns-off the first to third horizontal switches SW21 to SW23. When the same data signal is applied to horizontally adjacent pixels 100-1 and 100-2, the first to third horizontal switches SW21 to SW23 can be turned-on. Here, when the first to third horizontal switches SW21 to SW23 are turned-on, the anodes of the first OLEDs D1-1 and D1-2 can be electrically connected to each other, the anodes of the second OLEDs D2-1 and D2-2 can be electrically connected to each other, and the anodes of the third OLEDs D3-1 and D3-2 can be electrically connected to each other. Thus, a driving current can be shared between horizontally adjacent pixels 100-1 and 100-2. In addition, the bridge driving block 240 can receive the vertical bridge control signal VCSS from the vertical bridge control block 220*e*, and can turn-on or turn-off the first to third vertical switches SW24 to SW26.

When the same data signal is applied to vertically adjacent pixels 100-1 and 100-3, the first to third vertical switch SW24 to SW26 can be turned-on. Here, when the first to third vertical switches SW26 are turned-on, the anodes of the first OLEDs D1-1 and D1-3 can be electrically connected to each other, the anodes of the second OLEDs D2-1 and D2-3 can be electrically connected to each other, and the anodes of the third OLEDs D3-1 and D3-3 can be electrically connected to each other. Thus, a driving current can be shared between vertically adjacent pixels 100-1 and 100-3.

As a result, driving current of the red color sub-pixels 120-1 to 120-3 can become substantially equal to each other. In addition, driving currents of the green color sub-pixels 140-1 to 140-3 can become substantially equal to each other. Further, driving currents of the blue color sub-pixels 160-1 to 160-3 can become substantially equal to each other. Therefore, luminance non-uniformity among vertically and horizontally adjacent pixels 100-1, 100-2, and 100-3 can be efficiently prevented. Here, the horizontal bridge control block 220*d* and the vertical bridge control block 220*e* can operate based at least in part on respective data comparison signals. For example, when the same data signal is applied to horizontally adjacent pixels 100-1 and 100-2 and different data signals are applied to vertically adjacent pixels 100-1 and 100-3, the anodes of the first OLEDs D1-1 and D1-2 are electrically connected to each other, the anodes of the second OLEDs D2-1 and D2-2 are electrically connected to each other, the anodes of the third OLEDs D3-1 and D3-2 are electrically connected to each other, the anodes of the first OLEDs D1-1 and D1-3 are electrically separated from each other, the anodes of the second OLEDs D2-1 and D2-3 are electrically separated from each other, and the anodes of the third OLEDs D3-1 and D3-3 are electrically separated from each other. On the other hand, when different data signals are applied to horizontally adjacent pixels 100-1 and 100-2 and the same data signal is applied to vertically adjacent pixels 100-1 and 100-3, the anodes of the first OLEDs D1-1 and D1-2 can be electrically separated from each other, the anodes of the second OLEDs D2-1 and D2-2 can be electrically separated from each other, the anodes of the third OLEDs D3-1 and D3-2 can be electrically separated from each other. Furthermore, the anodes of the first OLEDs D1-1 and D1-3 can be electrically coupled to each other, the anodes of the second OLEDs D2-1 and D2-3 can be electrically coupled to each other, and the anodes of the third OLEDs D3-1 and D3-3 can be electrically coupled to each other.

Figure 11:
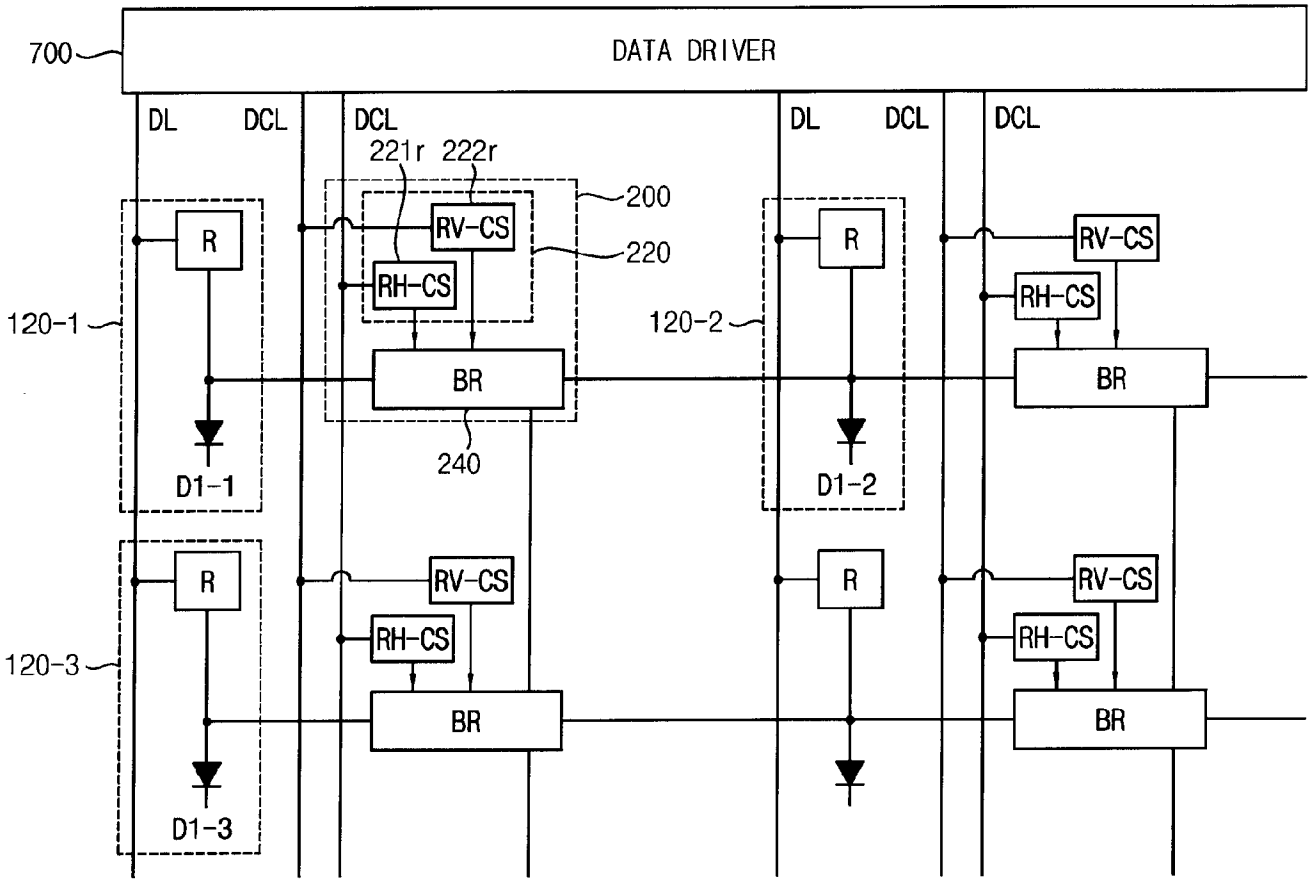
FIG. 11 is a diagram illustrating still another example embodiment in which a red color sub-pixel, a green color sub-pixel, and a blue color sub-pixel are connected to a bridge unit in the OLED display of FIG. 1.
Figure 12:
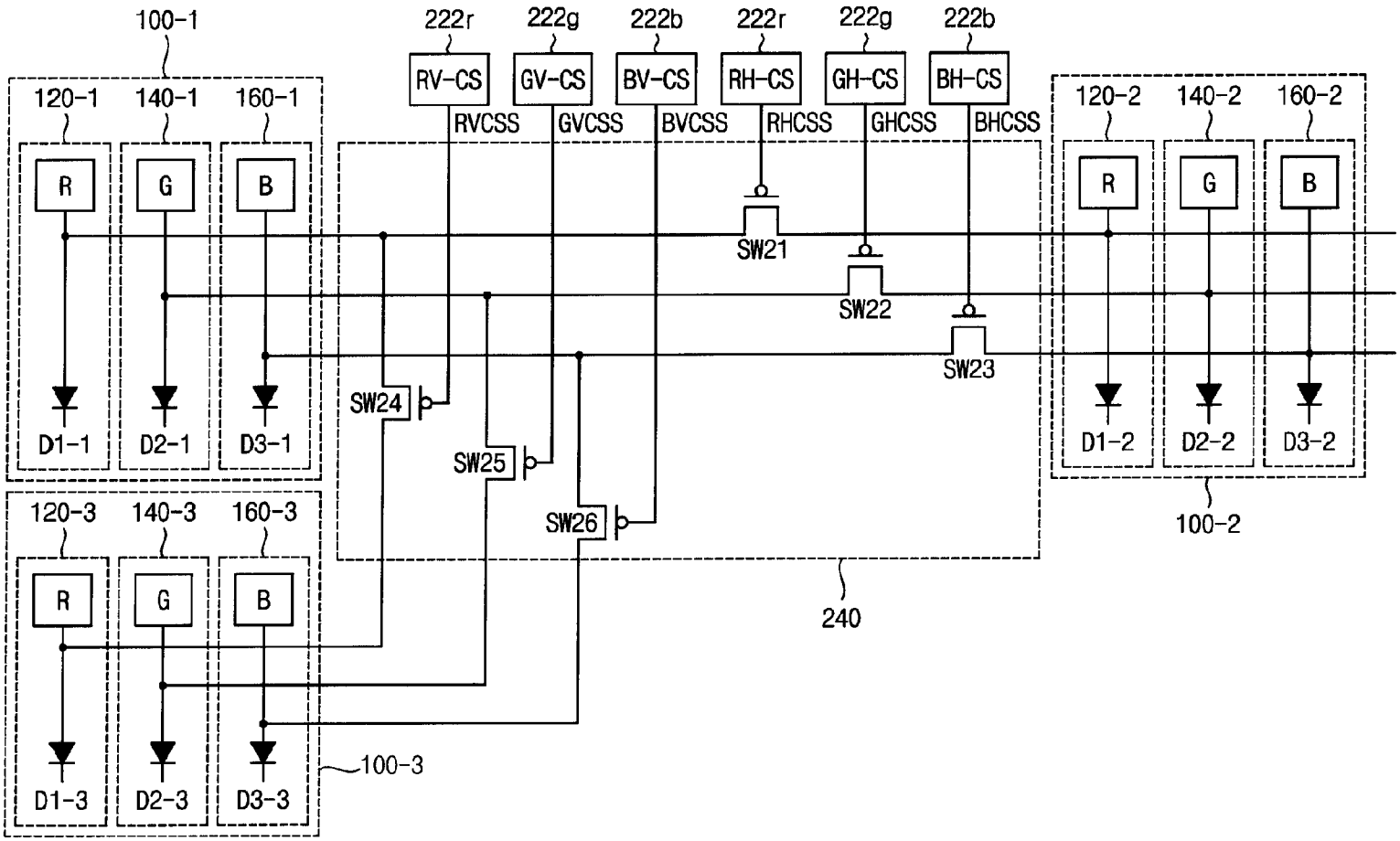
FIG. 12 is a diagram illustrating a detailed structure of the bridge unit in FIG. 11.

FIG. 11 is a diagram illustrating still another example embodiment in which red, green and blue color sub-pixels are connected to a bridge unit in the OLED display 1000 of FIG. 1. FIG. 12 is a diagram illustrating a detailed structure of the bridge unit in FIG. 11.

Referring to FIGS. 11 and 12, each pixel 100-1, 100-2, and 100-3 includes a red color sub-pixel 120-1, 120-2, and 120-3, a green color sub-pixel 140-1, 140-2, and 140-3, and a blue color sub-pixel 160-1, 160-2, and 160-3. Here, the red color sub-pixel 120-1, 120-2, and 120-3, the green color sub-pixel 140-1, 140-2, and 140-3, and the blue color sub-pixel 160-1, 160-2, and 160-3 can receive a data signal from the data driver 700 via the data line DL. The bridge unit 200 can include red, green and blue color horizontal bridge control blocks 221*r*, 221*g* and 221*b*, red green and blue color vertical bridge control blocks 222*r*, 222*g* and 222*b*, and a bridge driving block 240. Here, the red green and blue color horizontal bridge control blocks 221*r*, 221*g* and 221*b* and the red green and blue color vertical bridge control blocks 222*r*, 222*g* and 222*b* can receive a data comparison signal from the data driver 700 via the data comparison signal line DCL. For convenience of description, only red color components (i.e., the red color sub-pixel 120-1, 120-2, and 120-3, the red color horizontal bridge control block 221*r*, the red color vertical bridge control block 222*r*, and the bridge driving block 240) are illustrated in FIG. 11.

As illustrated in FIG. 12, the bridge driving block 240 includes first to third horizontal switches SW21 to SW23. The first horizontal switch SW21 can connect or separate anodes of first OLEDs D1-1 and D1-2 of horizontally adjacent pixels 100-1 and 100-2 to each other based at least in part on a red color horizontal bridge control signal RHCSS based at least in part on the bridge control signal CSS. The second horizontal switch SW22 can connect or separate anodes of second OLEDs D2-1 and D2-2 of horizontally adjacent pixels 100-1 and 100-2 to each other based at least in part on a green color horizontal bridge control signal GHCSS. The third horizontal switch SW23 can connect or separate anodes of third OLEDs D3-1 and D3-2 of horizontally adjacent pixels 100-1 and 100-2 to each other based at least in part on a blue color horizontal bridge control signal BHCSS. In addition, the bridge driving block 240 can include first to third vertical switches SW24 to SW26. The first vertical switch SW24 can connect or separate anodes of first OLEDs D1-1 and D1-3 of vertically adjacent pixels 100-1 and 100-3 to each other based at least in part on a red color vertical bridge control signal RVCSS. The second vertical switch SW25 can connect or separate anodes of second OLEDs D2-1 and D2-3 of vertically adjacent pixels 100-1 and 100-3 to each other based at least in part on a green color vertical bridge control signal GVCSS. The third vertical switch SW26 can connect or separate anodes of third OLEDs D3-1 and D3-3 of vertically adjacent pixels 100-1 and 100-3 to each other based at least in part on a blue color vertical bridge control signal BVCSS. Since switching operations of the bridge driving block 240 are described above, duplicated description related thereto will not be repeated.

Here, the red, green and blue color horizontal bridge control blocks 221*r*, 221*g* and 221*b* and the red, green and blue color vertical bridge control blocks 221, 221*g* and 222*b* can operate based at least in part on respective data comparison signals. For example, when the same data signal is applied to horizontally adjacent pixels 100-1 and 100-2 and different data signals are applied to vertically adjacent pixels 100-1 and 100-3, the anodes of the first OLEDs D1-1 and D1-2 are electrically connected to each other, the anodes of the second OLEDs D2-1 and D2-2 are electrically connected to each other, the anodes of the third OLEDs D3-1 and D3-2 are electrically connected to each other, the anodes of the first OLEDs D1-1 and D1-3 are electrically separated from each other, the anodes of the second OLEDs D2-1 and D2-3 are electrically separated from each other, and the anodes of the third OLEDs D3-1 and D3-3 are electrically separated from each other. In addition, when the same data signal is applied to horizontally adjacent red color sub-pixels 120-1 and 120-2, different data signals are applied to horizontally adjacent green color sub-pixels 140-1 and 140-2, and different data signals are applied to horizontally adjacent blue color sub-pixels 160-1 and 160-2, anodes of horizontally adjacent red color sub-pixels 120-1 and 120-2 can be electrically connected to each other, anodes of horizontally adjacent green color sub-pixels 140-1 and 140-2 can be electrically separated from each other, and anodes of horizontally adjacent blue color sub-pixels 160-1 and 160-2 can be electrically separated from each other.

Figure 13:
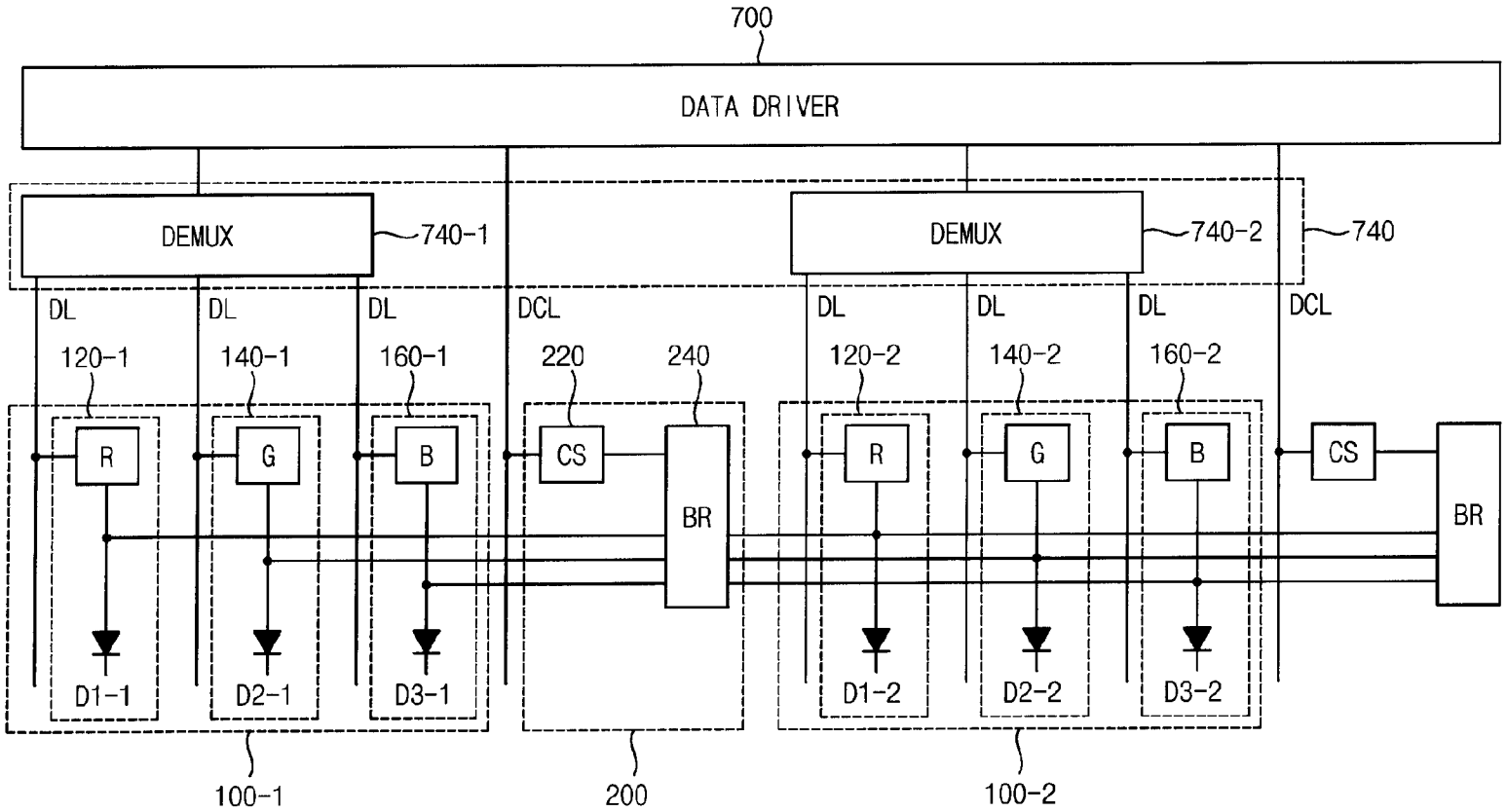
FIG. 13 is a diagram illustrating an example embodiment in which a red color sub-pixel, a green color sub-pixel, and a blue color sub-pixel are connected to a data driver by a demultiplexing structure in the OLED display of FIG. 1.

FIG. 13 is a diagram illustrating an example embodiment in which red, green and blue color sub-pixels are connected to a data driver by a demultiplexing structure in the OLED display 1000 of FIG. 1.

Referring to FIG. 13, each pixel 100-1 and 100-2 includes red color sub-pixels 120-1 and 120-2, green color sub-pixels 140-1 and 140-2, and blue color sub-pixels 160-1 and 160-2. Here, the red color sub-pixels 120-1 and 120-2 can receive a data signal corresponding to red color data from the demultiplexer unit 740, the green color sub-pixel 140-1 and 140-2 can receive a data signal corresponding to green color data from the demultiplexer unit 740, and the blue color sub-pixel 160-1 and 160-2 can receive a data signal corresponding to blue color data from the demultiplexer unit 740. The bridge unit 200-1 and 200-2 can include a bridge control block 220-1 and 220-2 and a bridge driving block 240-1 and 240-2. Here, the bridge control block 220-1 and 220-2 can receive a data comparison signal from the data driver 700 via a data comparison signal line DCL.

As illustrated in FIG. 13, the data driver 700 outputs a single data signal including red, green and blue color data to the demultiplexer unit 740 in a time division technique. The demultiplexer unit 740 can extract data signals corresponding to the red, green and blue color data from the single data signal to output the corresponding data signal to the red color sub-pixel 120-1 and 120-2, the green color sub-pixel 140-1 and 140-2, and the blue color sub-pixel 160-1 and 160-2. For example, the demultiplexer unit 740 can be located between the display panel 500 including the pixels 100-1 and 100-2 and the data driver 700. The demultiplexer unit 740 can alternately apply the data signal to the red color sub-pixel 120-1 and 120-2, the green color sub-pixel 140-1 and 140-2, and the blue color sub-pixel 160-1 and 160-2 in the time division technique according to colors. For this operation, the demultiplexer unit 740 can include a plurality of demultiplexers 740-1 and 740-2. In some embodiments, each demultiplexer 740-1 and 740-2 outputs one data signal at a time based at least in part on the colors. For example, during one horizontal period 1H, each demultiplexer 740-1 and 740-2 sequentially outputs the data signals respectively corresponding to the red, green and blue color data to the red color sub-pixel 120-1 and 120-2, the green color sub-pixel 140-1 and 140-2, and the blue color sub-pixel 160-1 and 160-2, respectively. In some embodiments, each demultiplexer 740-1 and 740-2 outputs a plurality of data signals at a time based at least in part on the colors. For example, during one horizontal period 1H, each demultiplexer 740-1 and 740-2 substantially simultaneously outputs the data signals corresponding to the red and blue color data to the red color sub-pixel 120-1 and 120-2 and the blue color sub-pixel 160-1 and 160-2, and then outputs the data signal corresponding to the green color data to the green color sub-pixel 140-1 and 140-2. However, operations of the demultiplexer unit 740 are not limited thereto.

Figure 14:
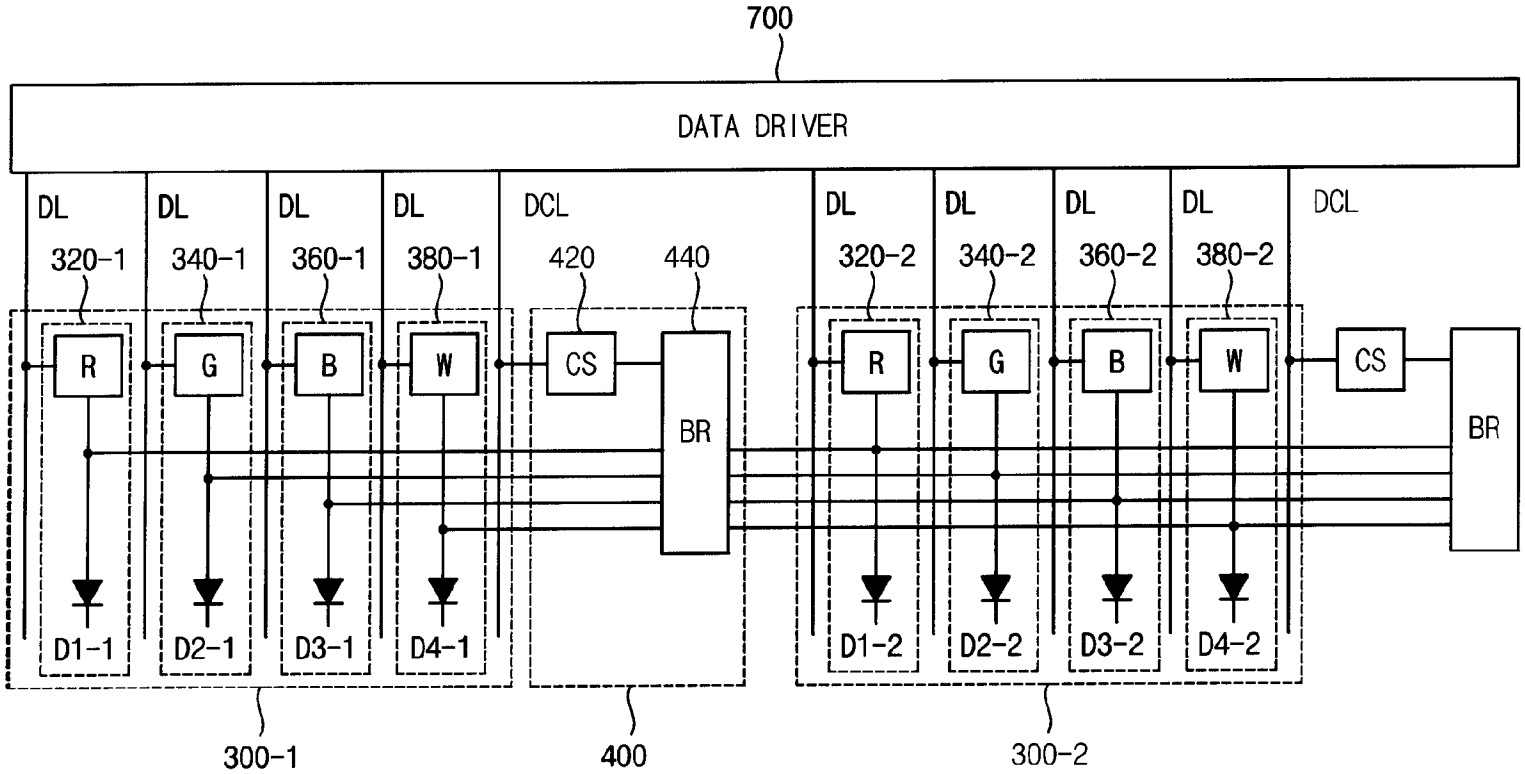
FIG. 14 is a diagram illustrating an example embodiment in which a red color sub-pixel, a green color sub-pixel, a blue color sub-pixel, and a white color sub-pixel are connected to a bridge unit in the OLED display of FIG. 1.

FIG. 14 is a diagram illustrating an example embodiment in which red, green, blue and white color sub-pixels are connected to a bridge unit in the OLED display 1000 of FIG. 1.

Referring to FIG. 14, each pixel 300-1 and 300-2 includes a red color sub-pixel 320-1 and 320-2, a green color sub-pixel 340-1 and 340-2, a blue color sub-pixel 360-1 and 360-2, and a white color sub-pixel 380-1 and 380-2. Here, the red color sub-pixel 320-1 and 320-2, the green color sub-pixel 340-1 and 340-2, the blue color sub-pixel 360-1 and 360-2, and the white color sub-pixel 380-1 and 380-2 can receive a data signal from the data driver 700 via the data line DL. The bridge unit 400 includes a bridge control block 420 and a bridge driving block 440. Here, the bridge control block 420 can receive a data comparison signal from the data driver 700 via the data comparison signal line DCL. Since a switch structure of the bridge unit 400 is a structure in which a switch structure for the white color sub-pixel 380-1 and 380-2 is added to a switch structure of the bridge unit 200 illustrated in FIG. 4, duplicated description related thereto will not be repeated.

In some embodiments, the bridge control block 420 can adjust a voltage level of a bridge control signal output to the bridge driving block 440 when the same data signal is applied to adjacent pixels 300-1 and 300-2. The bridge driving block 440 can receive the bridge control signal. In addition, when a data signal applied to the pixel 300-1 is the same as a data signal applied to the pixel 300-2, the bridge driving block 440 can electrically connect an anode of the first OLED D1-1 and an anode of the first OLED D1-2 to each other, electrically connect an anode of the second OLED D2-1 and an anode of the second OLED D2-2 to each other, electrically connect an anode of the third OLED D3-1 and an anode of the third OLED D3-2 to each other, and electrically connect an anode of the fourth OLED D4-1 and an anode of the fourth OLED D4-2 to each other. As a result, a driving current of the red color sub-pixel 320-1 can become substantially equal to a driving current of the red color sub-pixel 320-2, a driving current of the green color sub-pixel 340-1 can become substantially equal to a driving current of the green color sub-pixel 340-2, a driving current of the blue color sub-pixel 360-1 can become substantially equal to a driving current of the blue color sub-pixel 360-2, and a driving current of the white color sub-pixel 380-1 can become substantially equal to a driving current of the white color sub-pixel 380-2. As a result, luminance non-uniformity between adjacent pixels 300-1 and 300-2 can be prevented or reduced.

Figure 15:
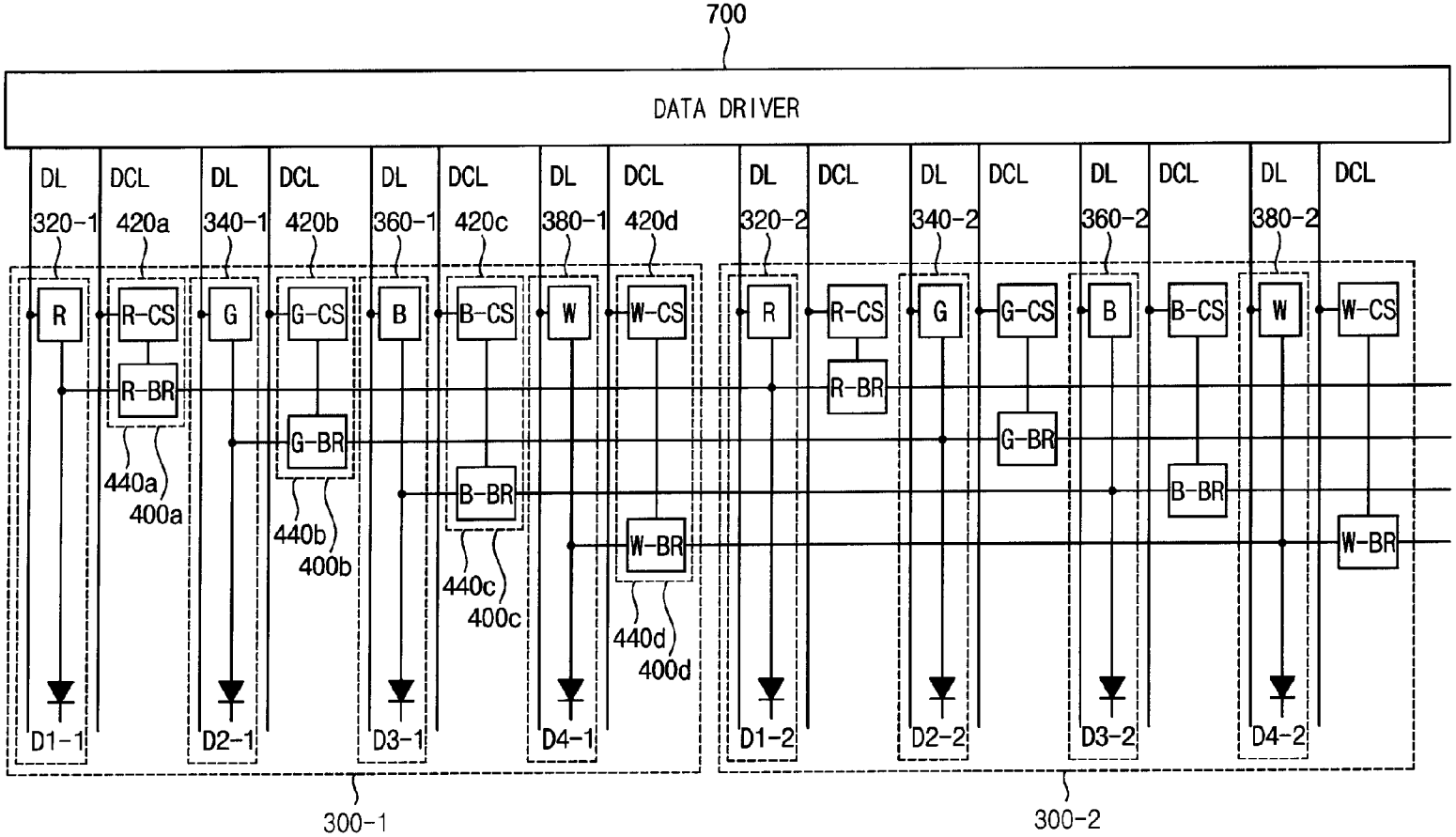
FIG. 15 is a diagram illustrating another example embodiment in which a red color sub-pixel, a green color sub-pixel, a blue color sub-pixel, and a white color sub-pixel are connected to a bridge unit in the OLED display of FIG. 1.

FIG. 15 is a diagram illustrating another example embodiment in which red, green, blue and white color sub-pixels are connected to a bridge unit in the OLED display 1000 of FIG. 1.

Referring to FIG. 15, each pixel 300-1 and 300-2 includes a red color sub-pixel 320-1 and 320-2, a green color sub-pixel 340-1 and 340-2, a blue color sub-pixel 360-1 and 360-2, and a white color sub-pixel 380-1 and 380-2. Here, the red color sub-pixel 320-1 and 320-2, the green color sub-pixel 340-1 and 340-2, the blue color sub-pixel 360-1 and 360-2, and the white color sub-pixel 380-1 and 380-2 can receive a data signal from the data driver 700 via the data line DL. The bridge unit 400 can include a bridge control block 420 and a bridge driving block 440. Here, the bridge control block 420 can receive a data comparison signal from the data driver 700 via the data comparison signal line DCL. Since a switch structure of the bridge unit 400 is a structure in which a switch structure for the white color sub-pixel 380-1 and 380-2 is added to a switch structure of the bridge unit 200 illustrated in FIG. 6, duplicated description related thereto will not be repeated.

As illustrated in FIG. 15, the bridge driving block 440 includes first to fourth bridge driving blocks 440*a* to 440*d*. The first bridge driving block 440*a* can connect or separate anodes of first OLEDs D1-1 and D1-2 to each other. The second bridge driving block 440*b* can connect or separate anodes of second OLEDs D2-1 and D2-2 to each other. The third bridge driving block 440*c* can connect or separate anodes of third OLEDs D3-1 and D3-2 to each other. The fourth bridge driving block 440*d* can connect or separate anodes of fourth OLEDs D4-1 and D4-2 to each other. As a result, red color sub-pixels of adjacent pixels 300-1 and 300-2, green color sub-pixels of adjacent pixels 300-1 and 300-2, blue color sub-pixels of adjacent pixels 300-1 and 300-2, and white color sub-pixels of adjacent pixels 300-1 and 300-2 can perform a driving current sharing operation.

Figure 16:
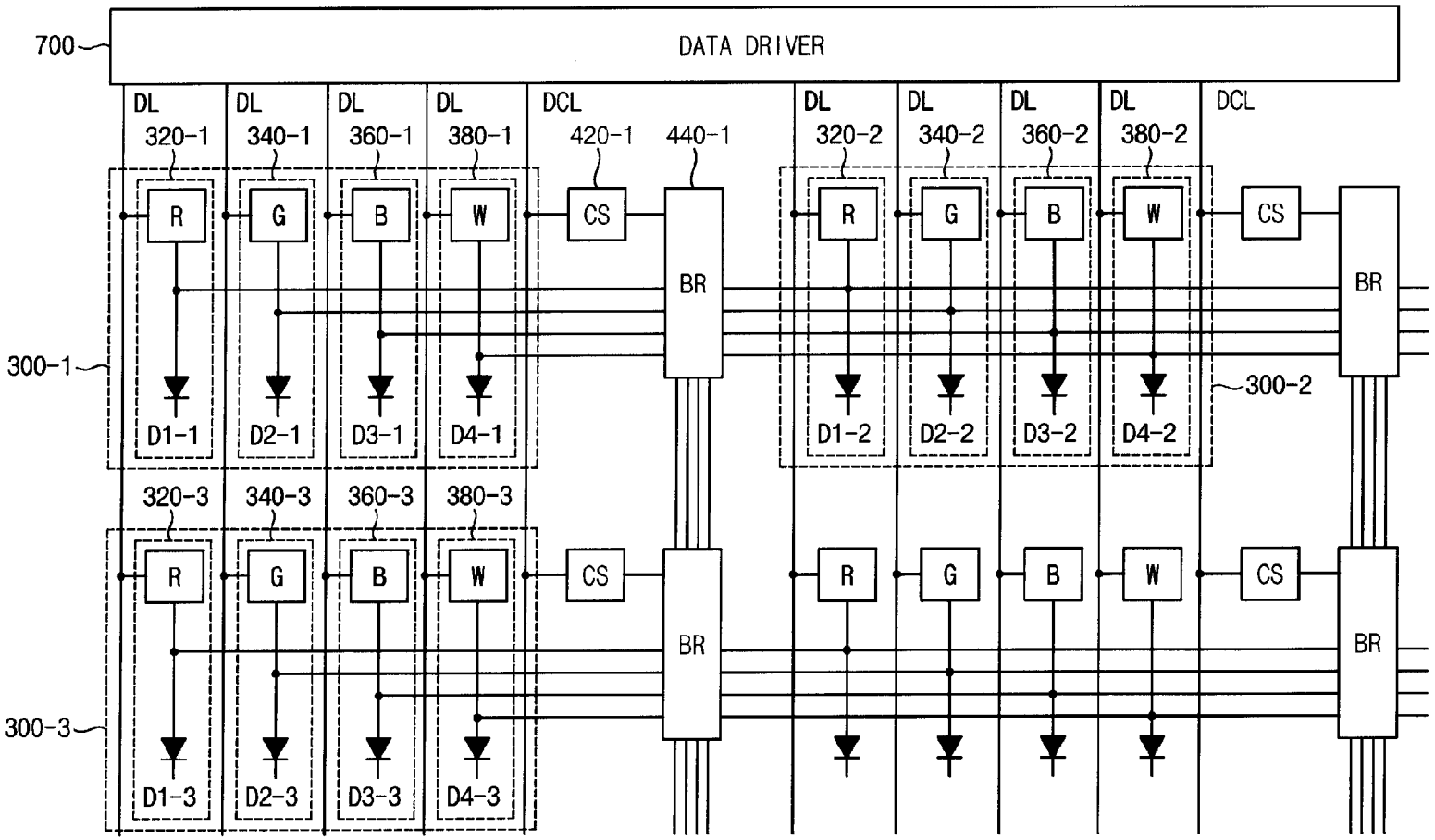
FIG. 16 is a diagram illustrating still another example embodiment in which a red color sub-pixel, a green color sub-pixel, a blue color sub-pixel, and a white color sub-pixel are connected to a bridge unit in the OLED display of FIG. 1.

FIG. 16 is a diagram illustrating still another example embodiment in which red, green, blue and white color sub-pixels are connected to a bridge unit in the OLED display 1000 of FIG. 1.

Referring to FIG. 16, each pixel 300-1, 300-2, and 300-3 includes a red color sub-pixel 320-1, 320-2, and 320-3, a green color sub-pixel 340-1, 340-2, and 340-3, a blue color sub-pixel 360-1, 360-2, and 360-3, and a white color sub-pixel 380-1, 380-2, and 380-3. Here, the red color sub-pixel 320-1, 320-2, and 320-3, the green color sub-pixel 340-1, 340-2, and 340-3, the blue color sub-pixel 360-1, 360-2, and 360-3, and the white color sub-pixel 380-1, 380-2, and 380-3 can receive a data signal from the data driver 700 via the data line DL, respectively. The bridge unit 400 can include a bridge control block 420 and a bridge driving block 440. Here, the bridge control block 420 can receive a data comparison signal from the data driver 700 via the data comparison signal line DCL. Since a switch structure of the bridge unit 400 is a structure in which a switch structure for the white color sub-pixel 380-1, 380-2, and 380-3 is added to a switch structure of the bridge unit 200 illustrated in FIG. 6, duplicated description related thereto will not be repeated.

As illustrated in FIG. 16, when the same data signal is applied to horizontally adjacent pixels 300-1 and 300-2, the bridge unit 400 connects anodes of first OLEDs D1-1 and D1-2 to each other, connects anodes of second OLEDs D2-1 and D2-2 to each other, connects anodes of third OLEDs D3-1 and D3-2 to each other, and connects anodes of fourth OLEDs D4-1 and D4-2 to each other. In addition, when the same data signal is applied to vertically adjacent pixels 300-1 and 300-3, the bridge unit 400 can connect anodes of first OLEDs D1-1 and D1-3 to each other, connect anodes of second OLEDs D2-1 and D2-3 to each other, connect anodes of third OLEDs D3-1 and D3-3 to each other, and connect anodes of fourth OLEDs D4-1 and D4-3 each other. That is, the bridge unit 400 can control a driving current sharing operation among adjacent pixels 300-1, 300-2, and 300-3 that are horizontally and vertically adjacent to each other.

Figure 17:
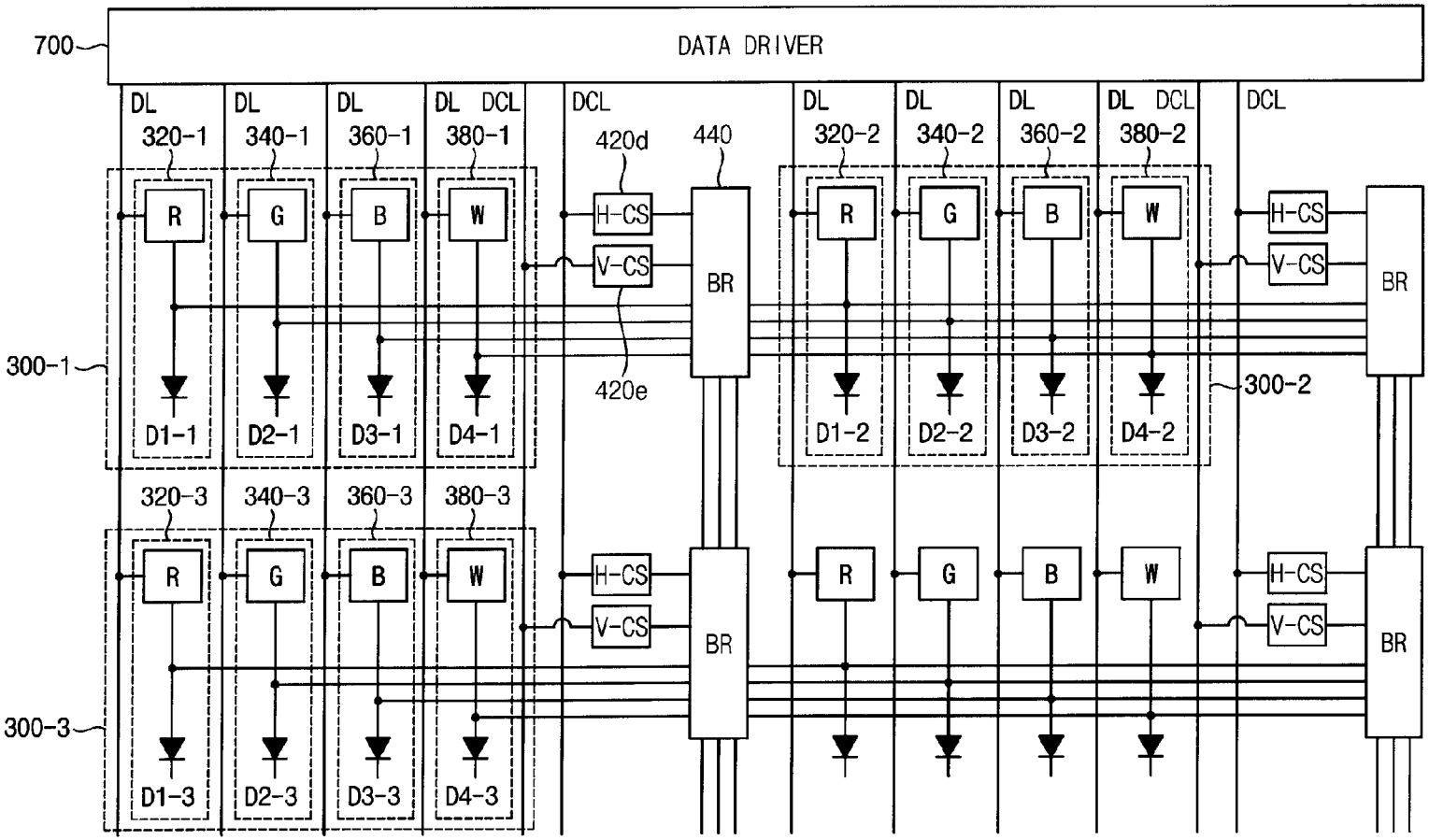
FIG. 17 is a diagram illustrating still another example embodiment in which a red color sub-pixel, a green color sub-pixel, a blue color sub-pixel, and a white color sub-pixel are connected to a bridge unit in the OLED display of FIG. 1.

FIG. 17 is a diagram illustrating still another example embodiment in which red, green, blue and white color sub-pixels are connected to a bridge unit in the OLED display 1000 of FIG. 1.

Referring to FIG. 17, each pixel 300-1, 300-2, and 300-3 includes a red color sub-pixel 320-1, 320-2, and 320-3, a green color sub-pixel 340-1, 340-2, and 340-3, a blue color sub-pixel 360-1, 360-2, and 360-3, and a white color sub-pixel 380-1, 380-2, and 380-3. Here, the red color sub-pixel 320-1, 320-2, and 320-3, the green color sub-pixel 340-1, 340-2, and 340-3, the blue color sub-pixel 360-1, 360-2, and 360-3, and the white color sub-pixel 380-1, 380-2, and 380-3 can receive a data signal from the data driver 700 via the data line DL. The bridge unit 400 can include a horizontal bridge control block 420*d*, a vertical bridge control block 420*e*, and a bridge driving block 440. Here, the horizontal bridge control block 420*d* and the vertical bridge control block 420*e* can receive a data comparison signal from the data driver 700 via the data comparison signal line DCL. Since a switch structure of the bridge unit 400 is a structure in which a switch structure for the white color sub-pixel 380-1, 380-2, and 380-3 is added to a switch structure of the bridge unit 200 illustrated in FIG. 10, duplicated description related thereto will not be repeated.

In some embodiments, when the same data signal is applied to horizontally adjacent pixels 300-1 and 300-2, the horizontal bridge control block 420*d* adjusts a voltage level of a horizontal bridge control signal output to the bridge driving block 440. In addition, when the same data signal is applied to vertically adjacent pixels 300-1 and 300-3, the vertical bridge control block 420*e* can adjust a voltage level of a vertical bridge control signal output to the bridge driving block 440. Thus, the bridge driving block 440 can receive the horizontal bridge control signal, and can electrically connect anodes of OLEDs D1-1 and D1-2 to each other, anodes of OLEDs D2-1 and D2-2 to each other, anodes of OLEDs D3-1 and D3-2 to each other, and anodes of OLEDs D4-1 and D4-2 to each other when the same data signal is applied to horizontally adjacent pixels 300-1 and 300-2. In addition, the bridge driving block 440 can receive the vertical bridge control signal, and can electrically connect anodes of OLEDs D1-1 and D1-3 to each other, anodes of OLEDs D2-1 and D2-3 to each other, anodes of OLEDs D3-1 and D3-3 to each other, and anodes of OLEDs D4-1 and D4-3 to each other when the same data signal is applied to vertically adjacent pixels 300-1 and 300-3. As a result, luminance non-uniformity among horizontally and vertically adjacent pixels 300-1, 300-2, and 300-3 can be prevented or reduced.

Figure 18:
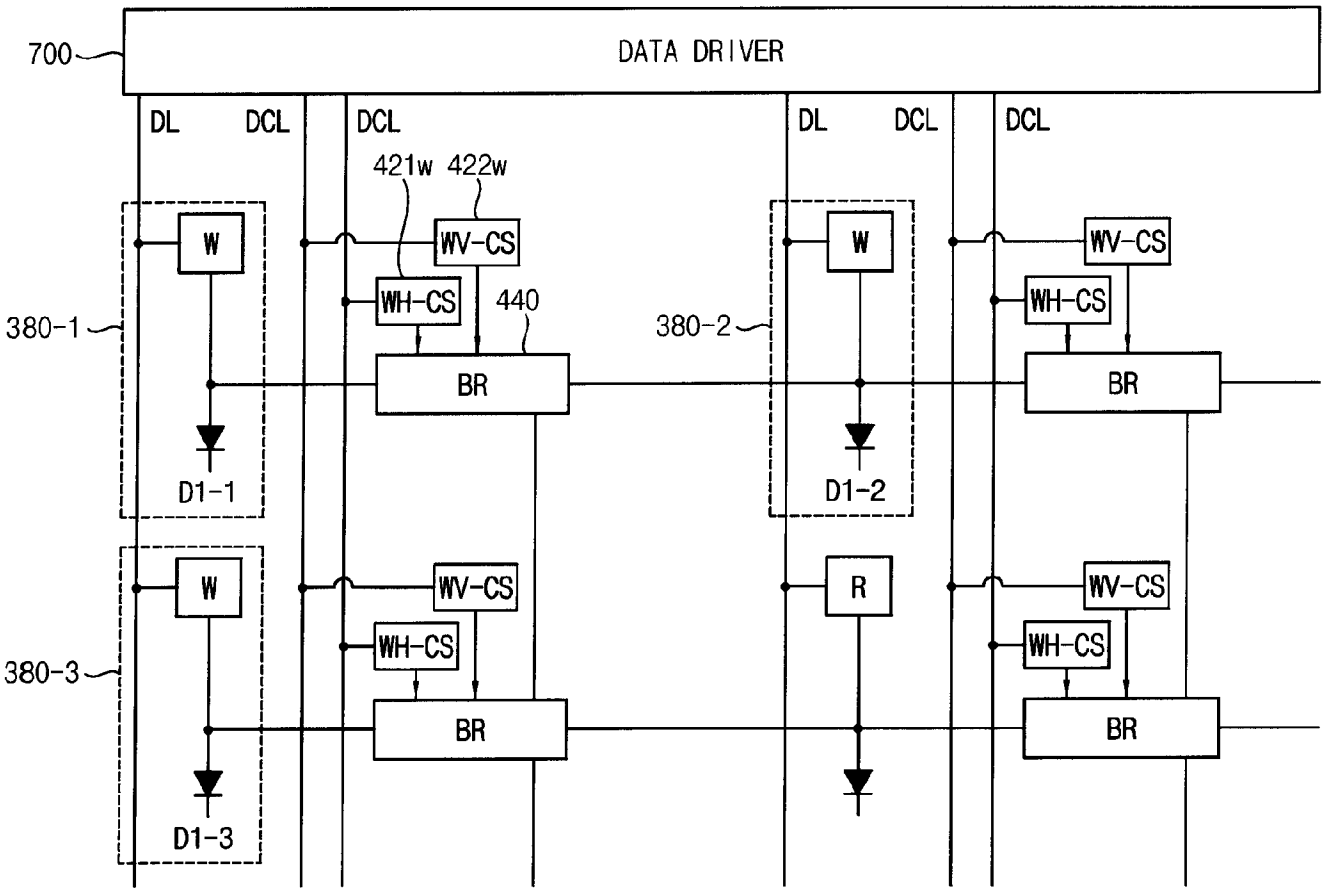
FIG. 18 is a diagram illustrating still another example embodiment in which a red color sub-pixel, a green color sub-pixel, a blue color sub-pixel, and a white color sub-pixel are connected to a bridge unit in the OLED display of FIG. 1.

FIG. 18 is a diagram illustrating still another example embodiment in which red, green, blue and white color sub-pixels are connected to a bridge unit in the OLED display 1000 of FIG. 1.

Referring to FIG. 18, each pixel 300-1, 300-2, and 300-3 includes a red color sub-pixel 320-1, 320-2, and 320-3, a green color sub-pixel 340-1, 340-2, and 340-3, a blue color sub-pixel 360-1, 360-2, and 360-3, and a white color sub-pixel 380-1, 380-2, and 380-3. For convenience of description, only the white color sub-pixel 380-1, 380-2, and 380-3 is illustrated in FIG. 18.

Here, the red color sub-pixel 320-1, 320-2, and 320-3, the green color sub-pixel 340-1, 340-2, and 340-3, the blue color sub-pixel 360-1, 360-2, and 360-3, and the white color sub-pixel 380-1, 380-2, and 380-3 can receive a data signal from the data driver 700 via the data line DL. The bridge unit 400 can include red, green, blue and white color horizontal bridge control blocks 421*r*, 421*g*, 421*b* and 421*w*, red, green, blue and white color vertical bridge control blocks 422*r*, 422*g*, 422*b* and 422*w*, and a bridge driving block 440. For convenience of description, only the white color horizontal bridge control block 421*w* and the white color vertical bridge control block 422*w* are illustrated in FIG. 18.

Here, the red, green, blue and white color horizontal bridge control blocks 421*r*, 421*g*, 421*b* and 421*w* and the red, green, blue and white color vertical bridge control blocks 422*r*, 422*g*, 422*b* and 422*w* can receive a data comparison signal from the data driver 700 via the data comparison signal line DCL. Since a switch structure of the bridge unit 400 is a structure in which a switch structure for the white color sub-pixel 380-1, 380-2, and 380-3 is added to a switch structure of the bridge unit 200 illustrated in FIG. 12, duplicated descriptions related thereto will not be repeated.

As illustrated in FIG. 18, since the red, green, blue and white color horizontal bridge control blocks 421*r*, 421*g*, 421*b* and 421*w* and the red, green, blue and white color vertical bridge control blocks 422*r*, 422*g*, 422*b* and 422*w* operate based at least in part on respective data comparison signals, red color sub-pixels of adjacent pixels 300-1, 300-2, and 300-3, green color sub-pixels of adjacent pixels 300-1, 300-2, and 300-3, blue color sub-pixels of adjacent pixels 300-1, 300-2, and 300-3, and white color sub-pixels of adjacent pixels 300-1, 300-2, and 300-3 can respectively perform a driving current sharing operation.

Figure 19:
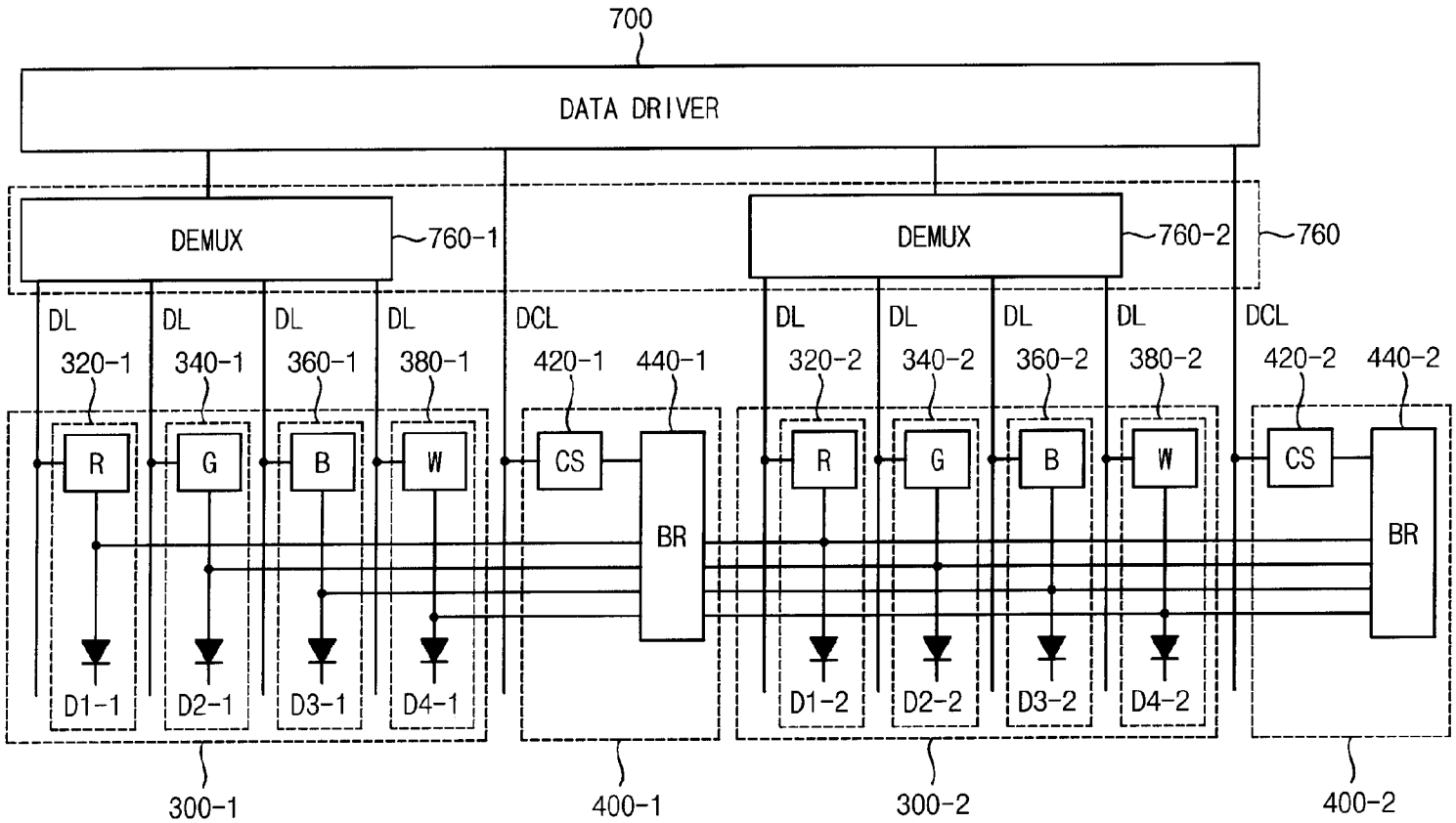
FIG. 19 is a diagram illustrating an example embodiment in which a red color sub-pixel, a green color sub-pixel, a blue color sub-pixel, and a white color sub-pixel are connected to a data driver by a demultiplexing structure in the OLED display of FIG. 1.

FIG. 19 is a diagram illustrating an example embodiment in which red, green, blue and white color sub-pixels are connected to a data driver by a demultiplexing structure in the OLED display 1000 of FIG. 1.

Referring to FIG. 19, each pixel 300-1 and 300-2 includes a red color sub-pixel 320-1 and 320-2, a green color sub-pixel 340-1 and 340-2, a blue color sub-pixel 360-1 and 360-2, and a white color sub-pixel 380-1 and 380-2. The red color sub-pixel 320-1 and 320-2 can receive a data signal corresponding to red color data from the demultiplexer unit 760. The green color sub-pixel 340-1 and 340-2 can receive a data signal corresponding to green color data from the demultiplexer unit 760. The blue color sub-pixel 360-1 and 360-2 can receive a data signal corresponding to blue color data from the demultiplexer unit 760.

The white color sub-pixel 380-1 and 380-2 can receive a data signal corresponding to white color data from the demultiplexer unit 760. The bridge units 400-1 and 400-2 respectively include bridge control blocks 420-1 and 420-2 and bridge driving blocks 440-1 and 440-2. The bridge control block 420-1 and 420-2 can receive a data comparison signal from the data driver 700 via the data comparison signal line DCL.

As illustrated in FIG. 19, the data driver 700 outputs a single data signal including the red, green, blue and white color data to the demultiplexer unit 760 in a time division technique. The demultiplexer unit 760 can extract the data signal corresponding to the red color data, the data signal corresponding to the green color data, the data signal corresponding to the blue color data, and the data signal corresponding to the white color data from the single data signal to output the data signals corresponding to the each color data to the respective red color sub-pixel 320-1 and 320-2, the green color sub-pixel 340-1 and 340-2, the blue color sub-pixel 360-1 and 360-2, and the white color sub-pixel 380-1 and 380-2. For example, the demultiplexer unit 760 is located between the display panel 500 including the pixels 300-1 and 300-2 and the data driver 700. The demultiplexer unit 760 can alternately apply the data signal to the red color sub-pixel 320-1 and 320-2, the green color sub-pixel 340-1 and 340-2, the blue color sub-pixel 360-1 and 360-2, and the white color sub-pixel 380-1 and 380-2 in the time division technique based at least in part on the colors. For this operation, the demultiplexer unit 760 can include a plurality of demultiplexers 760-1 and 760-2. In some embodiments, each demultiplexer 760-1 and 760-2 outputs one data signal at a time based at least in part on the colors. For example, during one horizontal period 1H, each demultiplexer 760-1 and 760-2 sequentially outputs the data signals corresponding red, green, blue and white color data to the red color sub-pixel 320-1 and 320-2, the green color sub-pixel 340-1 and 340-2, the blue color sub-pixel 360-1 and 360-2, and the white color sub-pixel 380-1 and 380-2, respectively. In some embodiments, each demultiplexer 760-1 and 760-2 outputs a plurality of data signals at a time based at least in part on the colors. For example, during one horizontal period 1H, each demultiplexer 760-1 and 760-2 substantially simultaneously outputs the data signal corresponding to the red color data and the data signal corresponding to the blue color data to the red color sub-pixel 320-1 and 320-2 and the blue color sub-pixel 360-1 and 360-2, and then outputs the data signal corresponding to the green color data and the data signal corresponding to the white color data to the green color sub-pixel 340-1 and 340-2 and the white color sub-pixel 380-1 and 380-2. However, operations of the demultiplexer unit 760 are not limited thereto.

Figure 20:
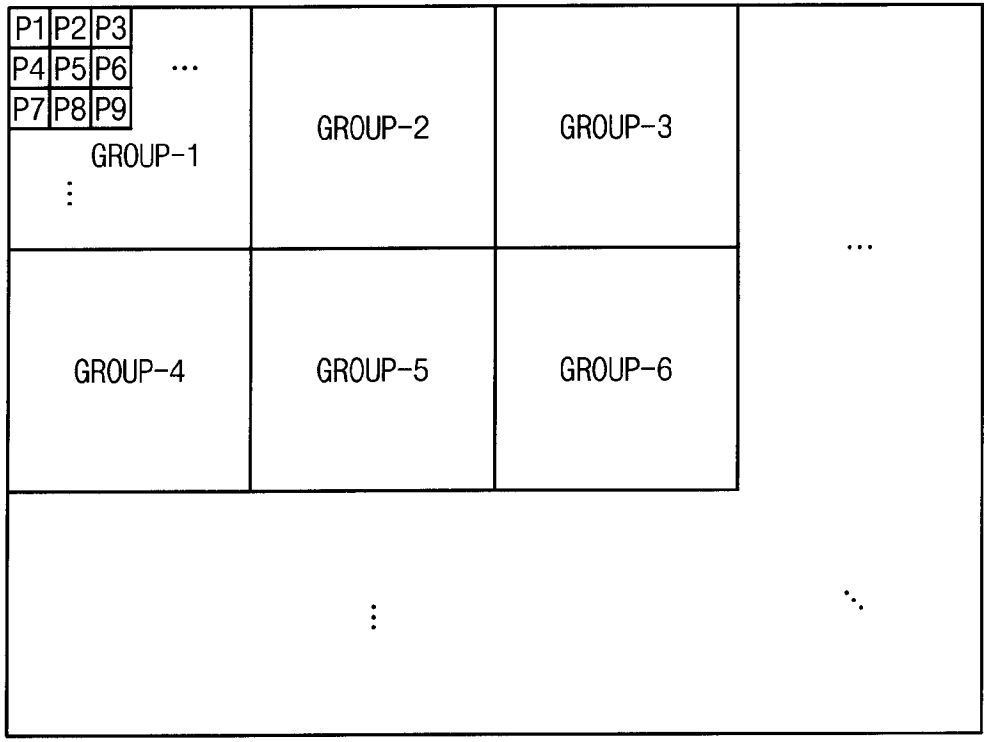
FIG. 20 is a diagram illustrating an example embodiment in which driving currents are shared between adjacent pixels in each pixel group of the OLED display of FIG. 1.

FIG. 20 is a diagram illustrating an example embodiment in which driving currents are shared between adjacent pixels in each pixel group of the OLED display 1000 of FIG. 1.

Referring to FIG. 20, the display panel 500 includes a plurality of pixel groups GROUP-1 through GROUP-k. Here, each of the pixel groups GROUP-1 through GROUP-k can include a plurality of pixels P1 through Pj. For example, the pixels P1 through Pj is grouped based at least in part on their locations on the display panel 500 to constitute the pixel groups GROUP-1 through GROUP-k.

The pixels P1 through Pj can be grouped based at least in part on their locations on the display panel 500. Here, a driving current sharing operation can be performed in each of the pixel groups GROUP-1 through GROUP-k. As described above, each pixel P1 through Pj can include an OLED. Thus, in each of the pixel groups GROUP-1 through GROUP-k, anodes of OLEDs of adjacent pixels P1 through Pj can be electrically connected to each other or separated from each other. For example, in each of the pixel groups GROUP-1 through GROUP-k, a driving current is shared by electrically connecting the anodes of the OLEDs of adjacent pixels P1 through Pj to each other when the same data signal is applied to adjacent pixels P1 through Pj. On the other hand, in some embodiments, a driving current is not shared by electrically separating the anodes of the OLEDs of adjacent pixels P1 through Pj from each other when different data signals are applied to adjacent pixels P1 through Pj. Since the pixel groups GROUP-1 through GROUP-k can perform a driving current sharing operation independently of each other (e.g., a driving current sharing operation is performed among a plurality of pixels P1 through Pj included in a first pixel group GROUP-1, and a driving current sharing operation is performed among a plurality of pixels P1 through Pj included in a second pixel group GROUP-2), luminance non-uniformity can be selectively prevented or reduced based at least in part on the locations on the display panel 500.

Figure 21:
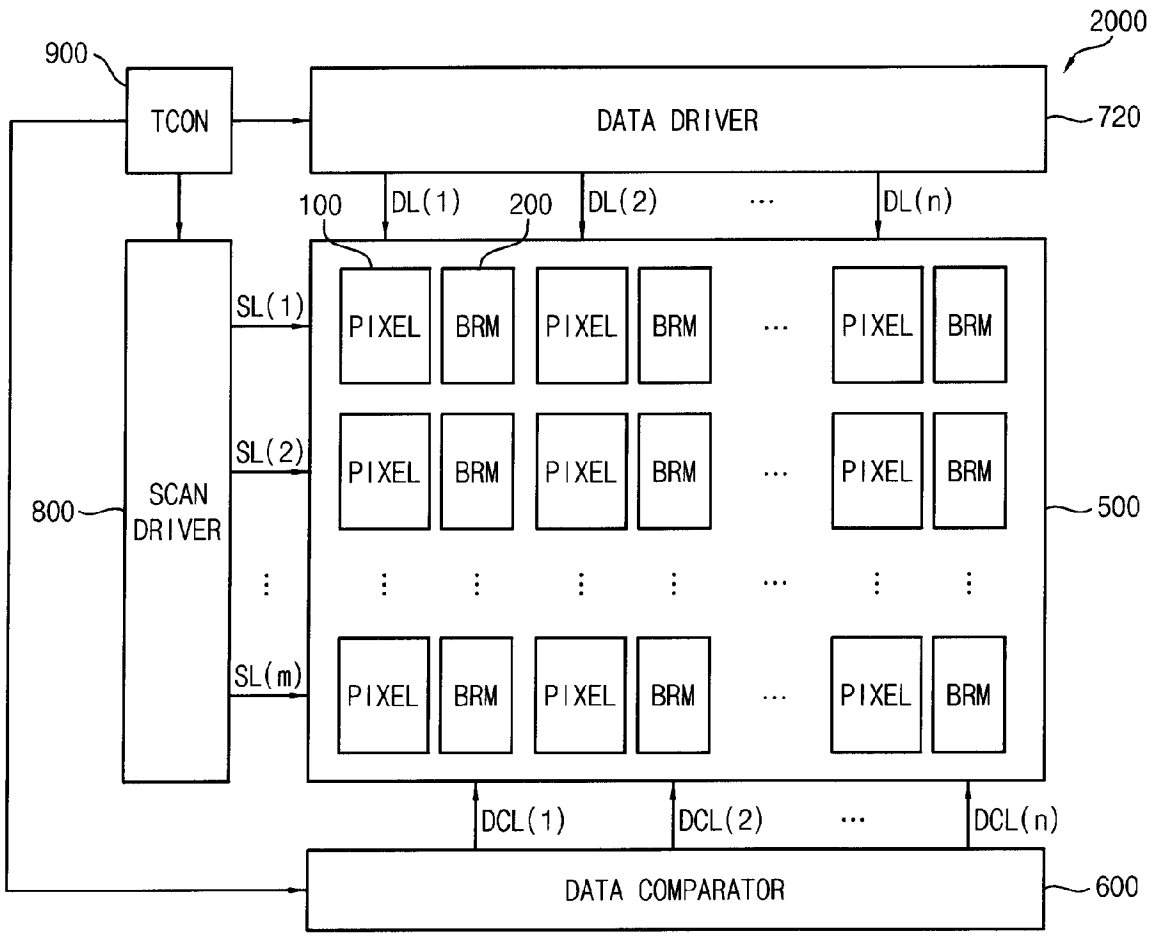
FIG. 21 is a block diagram illustrating an OLED display according to example embodiments.

FIG. 21 is a block diagram illustrating an OLED display according to example embodiments.

Referring to FIG. 21, the OLED display 2000 includes a display panel 500, a data comparator 600, a data driver 720, a scan driver 800, and a timing controller 900.

The display panel 500 includes a plurality of pixels 100. The display panel 500 can receive a scan signal from the scan driver 800 via a plurality of scan lines SL(1) through SL(m), a data signal from the data driver 720 via a plurality of data lines DL(1) through DL(n), and a data comparison signal from the data comparator 600 via a plurality of data comparison signal lines DCL(1) through DCL(n)). Here, the data comparison signal can have a first voltage level when the same data signal is applied to adjacent pixels 100 and a second voltage level that is different from the first voltage level when different data signals are applied to adjacent pixels 100. Thus, the data comparison signal can indicate whether the same data signal is applied to adjacent pixels 100. The timing controller 900 can control the data driver 720, the data comparator 600, and the scan driver 800. The bridge unit 200 can receive the scan signal and the data comparison signal, and control a driving current sharing operation for driving currents flowing through OLEDs of adjacent pixels 100 based at least in part on the scan signal and the data comparison signal.

For example, when the same data signal is applied to adjacent pixels 100, the data comparison signal for performing the driving current sharing operation among adjacent pixels 100 has the first voltage level. Thus, anodes of OLEDs of adjacent pixels 100 can be electrically connected to each other based at least in part on the data comparison signal having the first voltage level. As a result, luminance non-uniformity due to luminance distribution of the pixels 100 can be efficiently prevented or reduced because driving currents flowing through the OLEDs to which the same data signal is applied are shared. On the other hand, when different data signals are applied to adjacent pixels 100, the data comparison signal can have the second voltage level. Thus, the anodes of the OLEDs of adjacent pixels 100 can be electrically separated from each other based at least in part on the data comparison signal having the second voltage level. As a result, in some embodiments, the driving currents flowing through the OLEDs of adjacent pixels 100 to which different data signals are applied are not shared.

Figure 22:
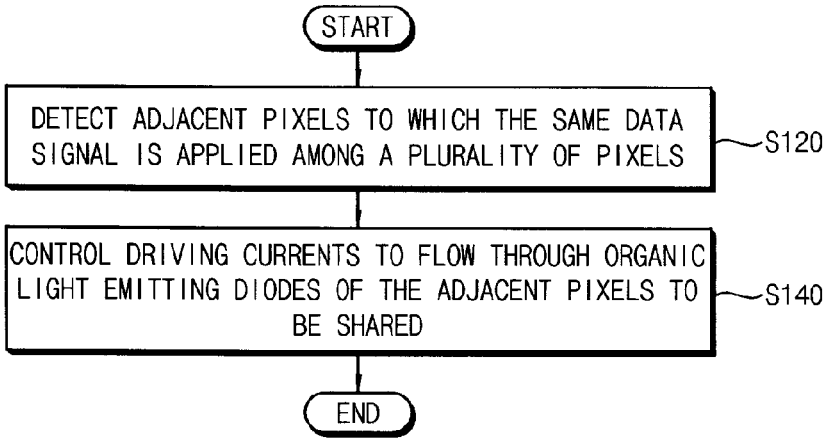
FIG. 22 is a flowchart illustrating a method of driving an OLED display according to example embodiments.
Figure 23:
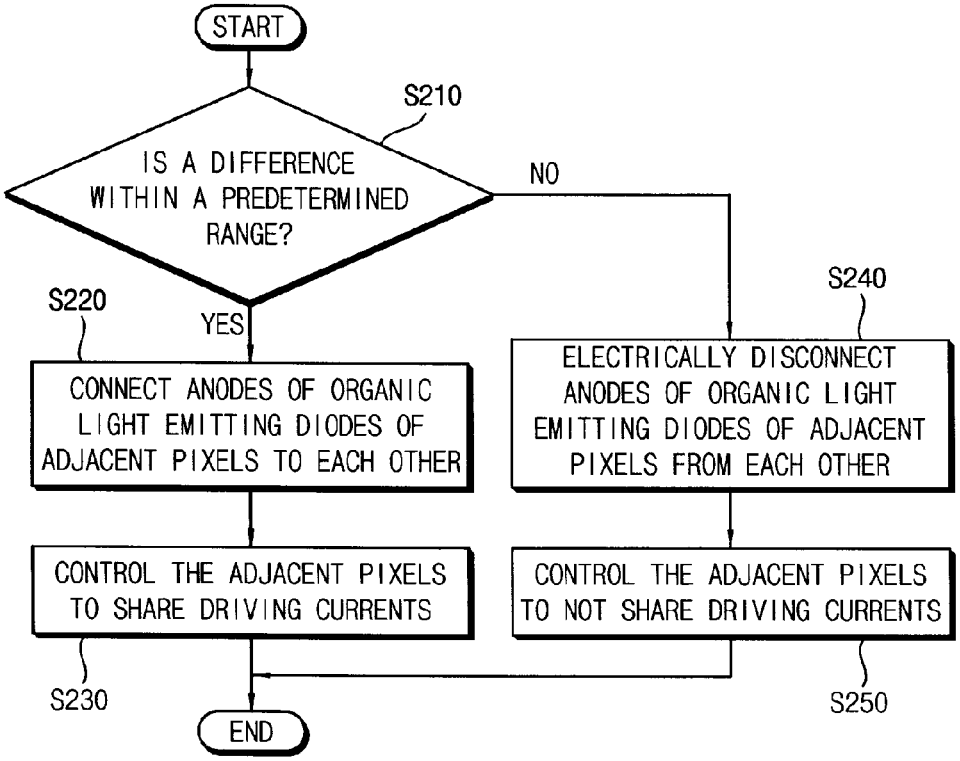
FIG. 23 is a flowchart illustrating a process in which driving currents are shared between adjacent pixels by the method of FIG. 22.

FIG. 22 is a flowchart illustrating a method of driving an OLED display according to example embodiments. FIG. 23 is a flowchart illustrating a process in which driving currents are shared between adjacent pixels by the method of FIG. 22.

In some embodiments, the FIG. 22 procedure is implemented in a conventional programming language, such as C or C++ or another suitable programming language. The program can be stored on a computer accessible storage medium of the OLED display 1000, for example, a memory (not shown) of the OLED display 1000 or the timing controller 900. In certain embodiments, the storage medium includes a random access memory (RAM), hard disks, floppy disks, digital video devices, compact discs, video discs, and/or other optical storage mediums, etc. The program can be stored in the processor. The processor can have a configuration based on, for example, i) an advanced RISC machine (ARM) microcontroller and ii) Intel Corporation's microprocessors (e.g., the Pentium family microprocessors). In certain embodiments, the processor is implemented with a variety of computer platforms using a single chip or multichip microprocessors, digital signal processors, embedded microprocessors, microcontrollers, etc. In another embodiment, the processor is implemented with a wide range of operating systems such as Unix, Linux, Microsoft DOS, Microsoft Windows 8/7/Vista/2000/9x/ME/XP, Macintosh OS, OS X, OS/2, Android, iOS and the like. In another embodiment, at least part of the procedure can be implemented with embedded software. Depending on the embodiment, additional states can be added, others removed, or the order of the states changed in FIG. 22. The description of this paragraph applies to the embodiments shown in FIG. 23.

Referring to FIGS. 22 and 23, the method of FIG. 22 includes detecting adjacent pixels to which the same data signal is applied among a plurality of pixels included in the OLED display (S120). The method also includes allowing driving currents flowing through OLEDs of the adjacent pixels to which the same data signal is applied to be shared (S140).

For example, the adjacent pixels to which the same data signal is applied are detected among the pixels included in the OLED display (S120). In some embodiments, the method of FIG. 22 includes detecting the adjacent pixels to which the same data signal is applied (S120) by checking whether a difference between data signals applied to adjacent pixels is within a predetermined range (S210). Here, the method of FIG. 22 can include determining that the same data signal is applied to adjacent pixels when a difference between data signals applied to the adjacent pixels is within the predetermined range, and determining that the same data signal is not applied to adjacent pixels when a difference between data signals applied to the adjacent pixels is not within the predetermined range. That is, it can be determined that a first data signal applied to a first pixel is the same as a second data signal applied to a second pixel, where the first pixel is located adjacent to the second pixel, when a difference between the first data signal and the second data signal is within the predetermined range. On the other hand, it can be determined that a first data signal applied to a first pixel is different from a second data signal applied to a second pixel, where the first pixel is located adjacent to the second pixel, when a difference between the first data signal and the second data signal is not within the predetermined range. Here, the predetermined range can be determined in various ways according to requirements of the OLED display as long as adjacent pixels emit light at substantially the same luminance.

Subsequently, the driving currents flowing through the OLEDs of the adjacent pixels to which the same data signal is applied can be shared (S140). Here, the method of FIG. 22 includes controlling adjacent pixels to which the same data signal is applied to share the driving currents (S230) by electrically connecting anodes of the OLEDs of the adjacent pixels to each other (S220). On the other hand, the method of FIG. 22 includes controlling adjacent pixels to which different data signals are applied not to share the driving currents (S250) by electrically separating anodes of the OLEDs of the adjacent pixels from each other (S240). In some embodiments, the method of FIG. 22 includes detecting adjacent pixels to which the same data signal is applied in a horizontal direction or in a vertical direction. In some embodiments, the method of FIG. 22 includes detecting adjacent pixels to which the same data signal is applied in a horizontal direction and in a vertical direction. As described above, the method of FIG. 22 includes checking whether the same data signal is applied to adjacent pixels, and controlling specific adjacent pixels to which the same data signal is applied to share driving currents flowing through OLEDs of the specific adjacent pixels. Thus, the method of FIG. 22 can improve luminance uniformity of the OLED display.

Figure 24:
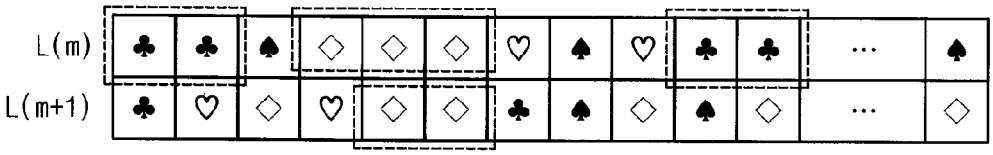
FIG. 24 is a diagram illustrating an example embodiment in which driving currents are shared between adjacent pixels by the method of FIG. 22.
Figure 25:
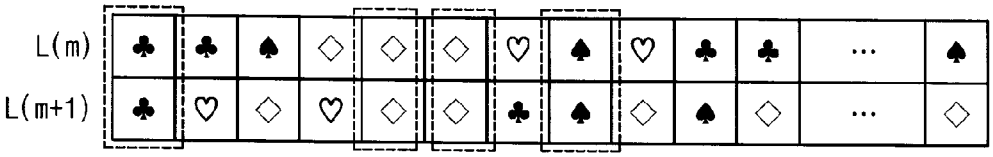
FIG. 25 is a diagram illustrating another example embodiment in which driving currents are shared between adjacent pixels by the method of FIG. 22.
Figure 26:
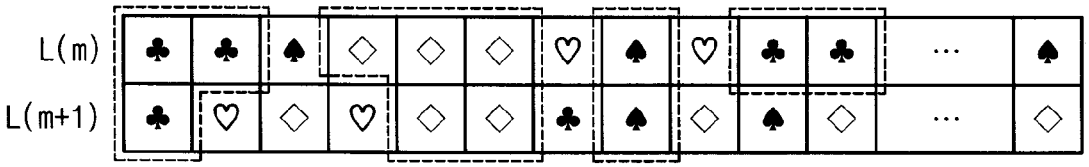
FIG. 26 is a diagram illustrating still another example embodiment in which driving currents are shared between adjacent pixels by the method of FIG. 22.

FIG. 24 is a diagram illustrating an example embodiment in which driving currents are shared between adjacent pixels by the method of FIG. 22. FIG. 25 is a diagram illustrating another example embodiment in which driving currents are shared between adjacent pixels by the method of FIG. 22. FIG. 26 is a diagram illustrating still another example embodiment in which driving currents are shared between adjacent pixels by the method of FIG. 22.

Referring to FIGS. 24 through 26, the pixels located on an (m)th horizontal line L(m) of the display panel and the pixels located on an (m+1)th horizontal line L(m+1) of the display panel are illustrated. For example, the pixels located on the (m)th horizontal line L(m) is a plurality of pixels that are connected to an (m)th scan line, and the pixels located on the (m+1)th horizontal line L(m+1) are a plurality of pixels that are connected to an (m+1)th scan line. As described above, the method of FIG. 22 include checking whether the same data signal is applied to adjacent pixels, and controlling specific adjacent pixels to which the same data signal is applied to share driving currents flowing through OLEDs of the specific adjacent pixels.

In some embodiments, as illustrated in FIG. 24, when a difference between data signals applied to horizontally adjacent pixels is within a predetermined range, the method of FIG. 22 includes controlling the horizontally adjacent pixels to share the driving currents. For example, when a first pixel is adjacent to a second pixel in a horizontal direction, the first and second pixels share the driving currents when a difference between a first data signal applied to the first pixel and a second data signal applied to the second pixel is within the predetermined range. On the other hand, in some embodiments, when a first pixel is adjacent to a second pixel in a horizontal direction and is adjacent to a third pixel in a vertical direction, the first and second pixels share the driving currents, but the first and third pixels do not share the driving currents even when a difference among a first data signal applied to the first pixel, a second data signal applied to the second pixel, and a third data signal applied to the third pixel is within the predetermined range. As a result, only horizontally adjacent pixels can share the driving currents.

In some embodiments, as illustrated in FIG. 25, when a difference between data signals applied to vertically adjacent pixels is within a predetermined range, the method of FIG. 22 includes controlling the vertically adjacent pixels to share the driving currents. For example, when a first pixel is adjacent to a third pixel in a vertical direction, the first and third pixels share the driving currents when a difference between a first data signal applied to the first pixel and a third data signal applied to the third pixel is within the predetermined range. On the other hand, when a first pixel is adjacent to a third pixel in a vertical direction and is adjacent to a second pixel in a horizontal direction in some embodiments, the first and third pixels share the driving currents, but the first and second pixels do not share the driving currents even when a difference among a first data signal applied to the first pixel, a second data signal applied to the second pixel, and a third data signal applied to the third pixel is within the predetermined range. As a result, only vertically adjacent pixels can share the driving currents.

In some embodiments, as illustrated in FIG. 26, when a difference between data signals applied to horizontally and vertically adjacent pixels is within a predetermined range, the method of FIG. 22 includes controlling the horizontally and vertically adjacent pixels to share the driving currents. For example, when a first pixel is adjacent to a second pixel in a horizontal direction and is adjacent to a third pixel in a vertical direction, the first to third pixels share the driving currents when a difference among a first data signal applied to the first pixel, a second data signal applied to the second pixel, and a third data signal applied to the third pixel is within the predetermined range. As a result, horizontally and vertically adjacent pixels can share the driving currents. In some embodiments, the method of FIG. 22 can improve luminance uniformity of the OLED display by checking whether the same data signal is applied to adjacent pixels and by controlling specific adjacent pixels to which the same data signal is applied to share driving currents flowing through OLEDs of the specific adjacent pixels.

The described technology can be applied to an OLED display and an electronic device including the OLED display. For example, the described technology can be applied to a monitor, a television, a computer, a laptop, a digital camera, a cellular phone, a smart phone, a smart pad, a tablet computer, a personal digital assistants (PDA), a portable multimedia player (PMP), an MP3 player, a navigation system, a camcorder, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the inventive technology. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. An organic light-emitting diode (OLED) display, comprising:

a display panel including a plurality of pixels each including an OLED through which driving current is configured to flow;

a scan driver configured to apply a scan signal to the display panel;

a data driver configured to apply a data signal via a data line and a data comparison signal via a data comparison signal line to the display panel, wherein the data line and the data comparison signal line are connected to the data driver and are separate lines, and wherein the data comparison signal indicates whether the same data signal is applied to adjacent pixels among the pixels;

a timing controller configured to control the scan driver and the data driver; and a bridge unit configured to control the OLEDs of the adjacent pixels to share the same driving current with each other based at least in part on the scan signal and the data comparison signal.

2. The display of claim 1, wherein the pixels include a first pixel and a second pixel adjacent to the first pixel, and wherein the bridge unit is further configured to determine whether a first data signal applied to the first pixel is substantially the same as a second data signal applied to the second pixel when the difference between the first and second data signals is within a predetermined range.

3. The display of claim 2, wherein the adjacent pixels are substantially horizontal to each other.

4. The display of claim 2, wherein the adjacent pixels are substantially vertical to each other.

5. The display of claim 1, wherein the bridge unit includes:

a bridge control block configured to i) receive the scan signal and the data comparison signal and ii) output a bridge control signal corresponding to a switch turn-on voltage or a switch turn-off voltage based at least in part on the scan signal and the data comparison signal; and a bridge driving block configured to electrically connect or disconnect the anodes of the OLEDs of the adjacent pixels to each other based at least in part on the bridge control signal.

6. The display of claim 5, wherein the bridge unit is further configured to electrically connect the anodes to each other when the same data signal is applied to the adjacent pixels, and wherein the bridge unit is further configured to electrically disconnect the anodes from each other when the same data signal is not applied to the adjacent pixels.

7. The display of claim 6, wherein each of the pixels includes:

a red color sub-pixel configured to output red color light based at least in part on the scan signal and the data signal, wherein the red color sub-pixel includes a first OLED;

a green color sub-pixel configured to output green color light based at least in part on the scan signal and the data signal, wherein the green color sub-pixel includes a second OLED; and a blue color sub-pixel configured to output blue color light based at least in part on the scan signal and the data signal, wherein the blue color sub-pixel includes a third OLED.

8. The display of claim 7, wherein the bridge driving block includes:

a first switch configured to electrically connect or disconnect the anodes of the first OLEDs of the adjacent pixels to each other based at least in part on the bridge control signal;

a second switch configured to electrically connect or disconnect the anodes of the second OLEDs of the adjacent pixels to each other based at least in part on the bridge control signal; and a third switch configured to electrically connect or disconnect the anodes of the third OLEDs of the adjacent pixels to each other based at least in part on the bridge control signal.

9. The display of claim 8, wherein the bridge control block includes:

a first bridge control block configured to provide a first bridge control signal, wherein the first bridge control signal is configured to turn-on or turn-off the first switch;

a second bridge control block configured to provide a second bridge control signal, wherein the second bridge control signal is configured to turn-on or turn-off the second switch; and a third bridge control block configured to provide a third bridge control signal, wherein the third bridge control signal is configured to turn-on or turn-off the third switch.

10. The display of claim 9, wherein each of the first through third bridge control blocks includes:

a transistor including a drain electrode and a gate electrode configured to receive the scan signal, and a source electrode configured to receive the data signal; and a capacitive element including a first electrode electrically connected to the drain electrode and a second electrode configured to receive to a bridge control reference voltage.

11. The display of claim 7, further comprising:

a demultiplexer configured to alternately apply the data signal to the red, green and blue color sub-pixels in a time division technique based at least in part on colors, wherein the demultiplexer is located between the display panel and the data driver.

12. The display of claim 6, wherein each of the pixels includes:

a red color sub-pixel including a first OLED and configured to output red color light based at least in part on the scan signal and the data signal;

a green color sub-pixel including a second OLED and configured to output green color light based at least in part on the scan signal and the data signal;

a blue color sub-pixel including a third OLED and configured to output blue color light based at least in part on the scan signal and the data signal; and a white color sub-pixel including a fourth OLED and configured to output white color light based at least in part on the scan signal and the data signal.

13. The display of claim 12, wherein the bridge driving block includes:

a first switch configured to electrically connect or disconnect the anodes of the first OLEDs of the adjacent pixels to each other based at least in part on, the bridge control signal;

a second switch configured to electrically connect or disconnect the anodes of the second OLEDs of the adjacent pixels to each other based at least in part on the bridge control signal;

a third switch configured to electrically connect or disconnect the anodes of the third OLEDs of the adjacent pixels to each other based at least in part on the bridge control signal; and a fourth switch configured to electrically connect or disconnect the anodes of the fourth OLEDs of the adjacent pixels to each other based at least in part on the bridge control signal.

14. The display of claim 13, wherein the bridge control block includes:

a first bridge control block configured to provide a first bridge control signal, wherein the first bridge control signal is configured to turn-on or turn-off the first switch;

a second bridge control block configured to provide a second bridge control signal, wherein the second bridge control signal is configured to turn-on or turn-off the second switch;

a third bridge control block configured to provide a third bridge control signal, wherein the third bridge control signal is configured to turn-on or turn-off the third switch; and a fourth bridge control block configured to provide a fourth bridge control signal, wherein the fourth bridge control signal is configured to turn-on or turn-off the fourth switch.

15. The display of claim 14, wherein each of the first through fourth bridge control blocks includes:

a transistor including a drain electrode, a gate electrode configured to receive the scan signal and a source electrode configured to receive the data signal; and a capacitive element including a first electrode electrically connected to the drain electrode and a second electrode electrically connected to a bridge control reference voltage.

16. The display of claim 12, further comprising:

a demultiplexer configured to alternately apply the data signal to the red, green, blue and white color sub-pixels in a time division technique based at least in part on the colors, wherein the demultiplexer is located between the display panel and the data driver.

17. The display of claim 1, wherein the pixels are grouped based at least in part on locations of the pixels on the display panel so as to form a plurality of pixel groups, and wherein the bridge unit is further configured to control the shared driving currents in each of the pixel groups.

18. The display of claim 1, wherein the bridge unit comprises a plurality of bridge unit circuits, and wherein each bridge unit circuit is interposed between adjacent pixels.

19. A method of driving an organic light-emitting diode (OLED) display including a plurality of pixels, the method comprising:

detecting adjacent pixels among the pixels to which the same data signal is applied, wherein each pixel includes an OLED, wherein each pixel is configured to receive the data signal via a data line and a data comparison signal via a data comparison signal line, and wherein the data line and the data comparison signal line are connected to the data driver and are separate lines; and controlling the adjacent pixels, based on the data signal and the data comparison signal, to share driving currents flowing through the OLEDs of the adjacent pixels with each other.

20. The method of claim 19, wherein the adjacent pixels include a first pixel and a second pixel, and wherein a first data signal applied to the first pixel is determined to be substantially the same as a second data signal applied to the second pixel when the difference between the first and second data signals is within a predetermined range.

21. The method of claim 19, wherein the driving currents are shared when the anodes of the OLEDs of the adjacent pixels are electrically connected to each other.

* * * * *